US008596740B2

(12) United States Patent
Oshima et al.

(10) Patent No.: US 8,596,740 B2
(45) Date of Patent: Dec. 3, 2013

(54) LIQUID JET APPARATUS AND PRINTING APPARATUS

(75) Inventors: Atsushi Oshima, Shiojiri (JP); Kunio Tabata, Shiojiri (JP); Noritaka Ide, Shiojiri (JP); Shinichi Miyazaki, Suwa (JP); Hiroyuki Aizawa, Shiojiri (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/353,224

(22) Filed: Jan. 18, 2012

(65) Prior Publication Data

US 2012/0120137 A1 May 17, 2012

Related U.S. Application Data

(62) Division of application No. 12/406,459, filed on Mar. 18, 2009, now abandoned.

(30) Foreign Application Priority Data

Mar. 19, 2008 (JP) ..... 2008-071942

(51) Int. Cl.
*B41J 2/01* (2006.01)

(52) U.S. Cl.
USPC ..... 347/14; 347/9; 347/5

(58) Field of Classification Search
USPC ..... 347/9, 10, 14, 11, 12, 5; 327/589
See application file for complete search history.

(56) References Cited

U.S. PATENT DOCUMENTS

| | | | | |
|---|---|---|---|---|
| 6,068,360 | A * | 5/2000 | Hiwada | 347/14 |
| 6,286,922 | B1 * | 9/2001 | Kondou | 347/10 |
| 6,302,504 | B1 * | 10/2001 | Imanaka et al. | 347/9 |
| 6,582,043 | B2 | 6/2003 | Ishizaki | |
| 7,581,802 | B2 | 9/2009 | Tabata et al. | |
| 7,585,037 | B2 | 9/2009 | Tabata et al. | |
| 7,758,140 | B2 | 7/2010 | Oshima et al. | |
| 2007/0126497 | A1 * | 6/2007 | Palaniappan et al. | 327/589 |
| 2008/0018683 | A1 | 1/2008 | Oshima et al. | |
| 2008/0018686 | A1 | 1/2008 | Oshima et al. | |

FOREIGN PATENT DOCUMENTS

| | | | |
|---|---|---|---|
| JP | 05-077456 | A | 3/1993 |
| JP | 11-204850 | A | 7/1999 |
| JP | 2000-218834 | A | 8/2000 |
| JP | 2000-263818 | A | 9/2000 |
| JP | 2008-044351 | A | 2/2008 |
| JP | 2008-049698 | A | 3/2008 |
| JP | 2008-049699 | A | 3/2008 |
| JP | 2008-049700 | A | 3/2008 |
| JP | 2008-087467 | A | 4/2008 |

OTHER PUBLICATIONS

United States Office Action dated Oct. 18, 2011 as received in U.S. Appl. No. 12/406,459.

* cited by examiner

*Primary Examiner* — Lam S Nguyen
(74) *Attorney, Agent, or Firm* — Maschoff Brennan

(57) ABSTRACT

A liquid jet apparatus according to the present invention includes a drive circuit adapted to apply a drive signal to an actuator of a liquid jet head, and a power supply voltage control circuit adapted to control a power supply voltage to the drive signal to be a waveform voltage set previously based on a reference signal obtained from one of the drive signal and a signal in a generation stage of the drive signal.

2 Claims, 21 Drawing Sheets

LIQUID JET APPARATUS AND PRINTING APPARATUS

BACKGROUND

1. Technical Field

The present invention relates to a liquid jet apparatus adapted to form predetermined characters and images by emitting microscopic droplets of liquids from a plurality of nozzles to form microscopic particles (dots) thereof on a medium.

2. Related Art

An inkjet printer as one of liquid jet printing apparatuses using a liquid jet apparatus can generally provide low-price and high quality color prints with ease, and therefore has widely been spreading not only to offices but also to general users along with widespread of personal computers and digital cameras. Some of such liquid jet apparatuses have a plurality of nozzles for emitting liquid jets, provided to a liquid jet head, each of the nozzles being provided with an actuator such as a piezoelectric element, and drive each of the actuators of the liquid jet head with a drive signal composed of waveform voltage signals, thereby emitting liquid jets from the corresponding nozzles towards a medium.

As power amplification of such a drive signal, the liquid jet apparatus described in JP-A-5-77456 is arranged to analog-convert a drive waveform signal forming a basis of a signal for controlling driving of the actuator with a D/A conversion circuit, and then power-amplify the analog drive waveform signal with an analog power amplifier, Further, the liquid jet apparatus described in JP-A-11-204850 is arranged to analog-convert the drive waveform signal with a D/A conversion circuit, then pulse-modulate the analog drive waveform signal, and then power-amplify the modulated signal with a digital power amplifier.

Incidentally, piezoelectric elements used as actuators of inkjet printers are charge-discharge actuators, and therefore, the drive signal charges the charge-discharge actuators and discharges the charge-discharge actuators. A digital power amplifier of the liquid jet apparatus described in JP-A-11-204850, although having an advantage of low loss and low heat generation, is provided with a low pass filter for smoothing the drive signal inserted on the output side thereof, and has a configuration of coupling the capacitance of the charge-discharge actuator to the low pass filter, and therefore, the waveform of the drive signal varies with the number of actuators coupled thereto. In contrast, the analog power amplifiers do not have low pass filters on the output side, and therefore, the waveform of the drive signal does not vary even if the number of actuators coupled thereto varies.

However, the analog power amplifier for charging the charge-discharge actuator and discharging the charge-discharge actuator is composed of a charging transistor and a discharging transistor push-pull coupled to each other, and amplifies the drive signal using a high power-supply voltage with linear driving, and therefore, has a large difference in voltage between the power supply voltage and the drive signal for charging the charge-discharge actuator and a large difference in voltage between the drive signal for discharging the charge-discharge actuator and the ground voltage, and accordingly has large power consumption. Since the power consumption is mostly consumed as heat, the drive circuit for generating the drive signal requires a large-sized transistor and a heat sink, the mounting area on the circuit board becomes extremely large, and in particular the size of the heat sink causes difficulty in the layout,

SUMMARY

The invention has an object of providing a liquid jet apparatus capable of reducing the difference voltage between the power supply voltage and the drive signal, thereby reducing the loss and heat generation.

A liquid jet apparatus according to the present invention includes a drive circuit adapted to apply a drive signal to an actuator of a liquid jet head, and a power supply voltage control circuit adapted to control a power supply voltage to the drive signal to be a waveform voltage set previously based on a reference signal obtained from one of the drive signal and a signal in a generation stage of the drive signal, The power supply voltage to the drive signal of the invention represents the power supply voltage including the charge source power supply voltage and the discharge destination power supply voltage of the actuator formed of a charge-discharge actuator such as a piezoelectric element instead of simply representing the upper limit value of the power supply voltage necessary for generating the drive signal, and specifically includes the terminal voltage of a pair of transistors of the power amplifier push-pull coupled to each other.

According to the liquid jet apparatus, the difference in voltage between the drive signal for charging the actuator formed of a charge-discharge actuator or the drive signal for discharging the actuator and the power supply voltage can be reduced, thus it becomes possible to reduce the loss and the heat generation.

Further, in the liquid jet apparatus according to the invention, the drive circuit is configured including a drive waveform generator adapted to generate a drive waveform signal, a D/A converter adapted to analog-convert the drive waveform signal to form an analog drive waveform signal, a power amplifier adapted to power-amplify the analog drive waveform signal to form the drive signal, and a pre-driver circuit adapted to drive the power amplifier, and the reference signal is generated based on an output signal of either one of the drive waveform generator, the D/A converter, the pre-driver circuit, and the power amplifier.

According to the liquid jet apparatus, improvement in accuracy of the drive signal and further reduction of the loss and the heat generation become possible.

Further, in the liquid jet apparatus according to the invention, the power supply voltage control circuit is configured including a plurality of power supply voltage generation circuits adapted to generate a plurality of power supply voltages, and a power supply voltage selection circuit adapted to select either one of the plurality of power supply voltages.

Further, in the liquid jet apparatus according to the invention, the power supply voltage control circuit is configured including a power supply voltage generation circuit adapted to generate a power supply voltage, a plurality of voltage control circuits adapted to control the power supply voltage to be a plurality of power supply voltages, and a power supply voltage selection circuit adapted to select either one of the plurality of power supply voltages.

According to the liquid jet apparatus, the difference in voltage between the drive signal and the power supply voltage is further reduced, thus further reduction of the loss and the heat generation become possible.

Further, in the liquid jet apparatus according to the invention, the power supply voltage control circuit is configured with a power supply circuit capable of stepping up a power supply voltage with a bootstrap circuit, and controls stepping up of the power supply voltage with the bootstrap circuit with the reference signal.

According to the liquid jet apparatus, it becomes possible to obtain a higher power supply voltage to the drive signal using a lower power supply voltage.

Further, in the liquid jet apparatus according to the invention, a diode adapted to prevent back-flow is disposed on an output side of the bootstrap circuit.

According to the liquid jet apparatus, the waveform of the drive signal can be maintained,

DESCRIPTION OF EXEMPLARY EMBODIMENTS

A first embodiment of a liquid jet printing apparatus using a liquid jet apparatus of the invention will hereinafter be explained.

Figure 1:
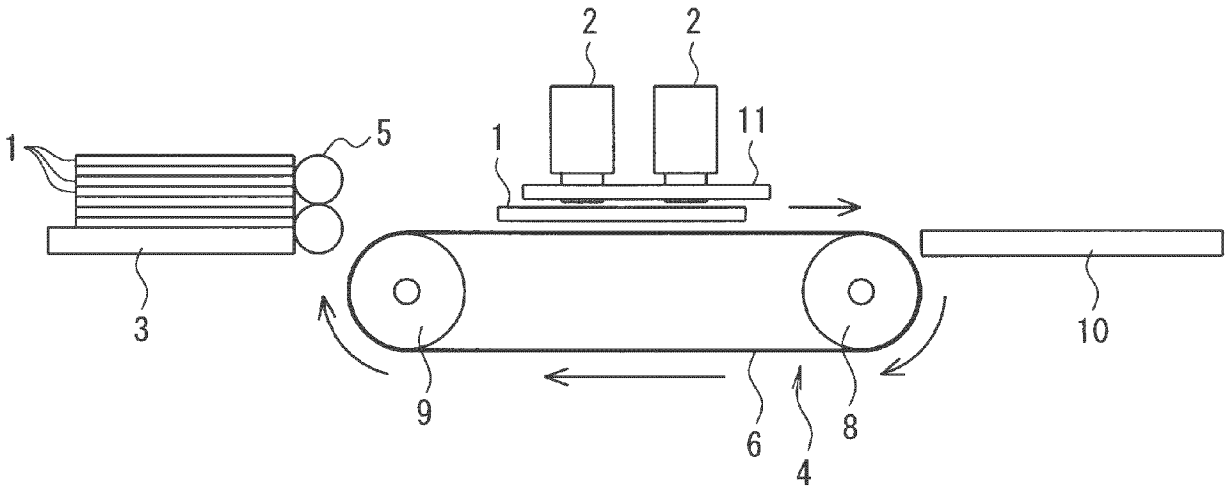
FIG. 1 is a schematic front view showing a first embodiment of a liquid jet printing apparatus to which the liquid jet apparatus of the invention is applied.

FIG. 1 is a schematic configuration diagram of the liquid jet printing apparatus of the first embodiment, and in FIG. 1, in the line head-type printing apparatus, a print medium 1 is conveyed from the left to the right of the drawing in the arrow direction, and printed in a printing area during the conveying operation.

Figure 2:
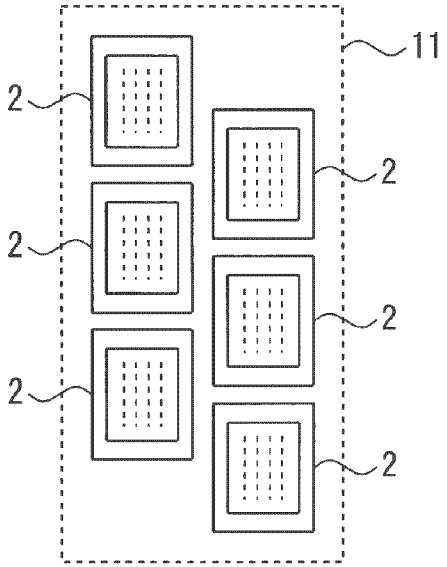
FIG. 2 is a plan view of a vicinity of a liquid jet head used in the liquid jet apparatus shown in FIG. 1.

A reference numeral 2 shown in FIG. 1 denotes six liquid jet heads disposed above a conveying line of the print medium 1, which are fixed individually to a head fixing plate 11 in such a manner as to form two lines in the print medium conveying direction and to be arranged in a direction perpendicular to the print medium conveying direction. FIG. 2 is a plan view of the liquid jet head 2. The liquid jet head 2 is provided with a number of nozzles, and the surface thereof is called a nozzle surface.

A line head extending over the entire length in the direction traversing the conveying direction of the print medium 1 is formed of the liquid jet heads 2. When the print medium 1 passes through under the nozzle surface of the liquid jet head 2, a liquid jet is emitted from the number of nozzles provided to the nozzle surface, and printing is performed. Further, in the liquid jet head 2 of the first embodiment, the nozzles are opened on the nozzle surface in a zigzag manner. By thus opening the nozzles in a zigzag manner, it is possible to reduce the distance between the nozzles adjacent to each other in a direction traversing the print medium conveying direction, namely a so-called pixel pitch.

The liquid jet head 2 is supplied with liquids such as ink of four colors of yellow (Y), magenta (M), cyan (C), and black (K) from liquid tanks of respective colors not shown via liquid supply tubes. The liquid jet heads 2 are each provided with the plurality of nozzles formed in the direction perpendicular to the conveying direction of the print medium 1, and emit a necessary amount of liquid jet from the respective nozzles simultaneously to the necessary positions, thereby forming microscopic dots on the print medium 1. By executing the above for each of the colors, one-pass printing can be performed only by making the print medium 1 to be conveyed by a conveying section 4 pass through once.

As a method of emitting a liquid jet from the nozzles of the liquid jet head 2, there can be cited an electrostatic driving method, a piezoelectric driving method, a film boiling liquid jet method, and so on, and in the first embodiment there is used the piezoelectric driving method. In the piezoelectric driving method, when a drive signal is provided to a piezoelectric element as an actuator, a diaphragm in a cavity is displaced to cause pressure variation in the cavity, and the liquid jet is emitted from the nozzle in response to the pressure variation. Further, by controlling the wave height and the voltage variation gradient of the drive signal, it becomes possible to control the amount of liquid jet to be emitted therefrom. It should be noted that the piezoelectric element used in the piezoelectric driving method is a capacitive load, and is charged by the drive signal and discharges electric charge to the drive signal side. Further, the invention can also be applied to liquid jet methods other than the piezoelectric driving method.

Under the liquid jet head 2, there is disposed the conveying section 4 for conveying the print medium 1 in the conveying direction. The conveying section 4 is configured by winding a conveying belt 6 around a drive roller 8 and a driven roller 9, and an electric motor not shown is coupled to the drive roller 8. Further, in the inside of the conveying belt 6, there is disposed an absorption apparatus, not shown, for absorbing the print medium 1 on the surface of the conveying belt 6. For the absorption apparatus there is used an air suction apparatus for absorbing the print medium 1 to the conveying belt 6 with negative pressure, or an electrostatic absorption apparatus for absorbing the print medium 1 to the conveying belt 6 with electrostatic force.

Therefore, when a feed roller 5 feeds just one sheet of the print medium 1 on the conveying belt 6 from a feeder section 3, and then the electric motor rotationally drives the drive roller 8, the conveying belt 6 is rotated in the print medium conveying direction, and the print medium 1 is conveyed while being absorbed to the conveying belt 6 by the absorption apparatus. While conveying the print medium 1, printing is performed by emitting liquid jets from the liquid jet heads 2. The print medium 1 printing on which has been completed is ejected to a catch tray 10 disposed on the downstream side in the conveying direction.

Figure 3:
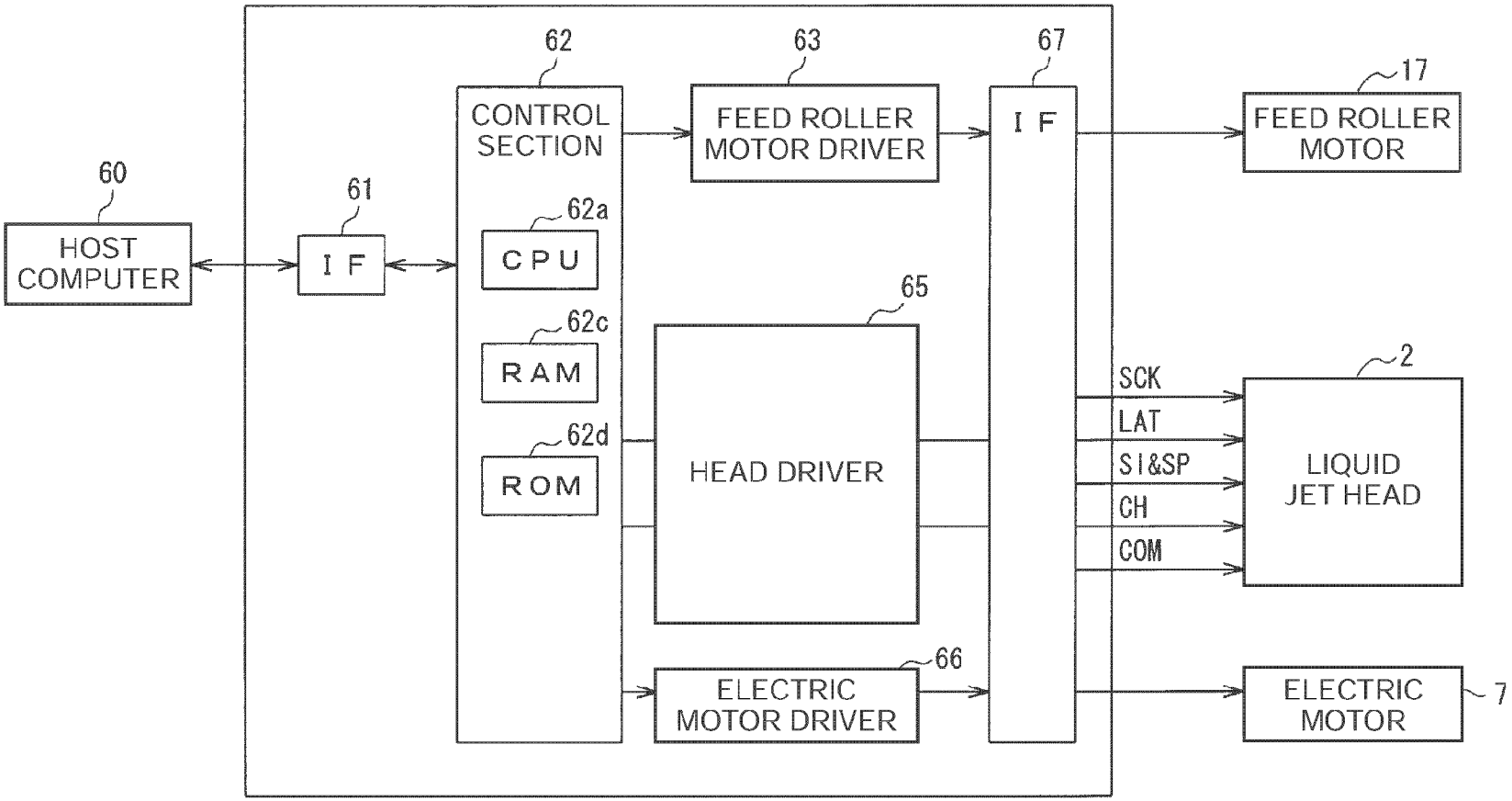
FIG. 3 is a block diagram of a control apparatus of the liquid jet printing apparatus shown in FIG. 1.

Inside the liquid jet printing apparatus, there is provided a control apparatus for controlling the liquid jet printing apparatus. As shown in FIG. 3, the control apparatus is configured including an input interface 61 for receiving print data input from a host computer 60, a control section 62 configured with a microcomputer for executing a print process in accordance with the print data input from the input interface 61, a feed roller motor driver 63 for controlling driving of a feed roller motor 17 coupled to the feed roller 5, a head driver 65 for controlling driving of the liquid jet heads 2, an electric motor driver 66 for controlling driving of an electric motor 7 coupled to the drive roller 8, and an interface 67 for connecting the feed roller motor driver 63, the head driver 65, and the electric motor driver 66, to the feed roller motor 17, the liquid jet heads 2, and the electric motor 7, respectively.

The control section 62 is provided with a central processing unit (CPU) 62*a* for performing various processes such as a printing process, a random access memory (RAM) 62*c* for temporarily storing the print data input via the input interface 61 and various kinds of data used when performing the printing process, and for temporarily developing a program, for example, for the printing process, and a read-only memory (ROM) 62*d* formed of a nonvolatile semiconductor memory and for storing, for example, the control program executed by the CPU 62*a*.

When the control section 62 receives the print data (the image data) from the host computer 60 via the input interface 61, the CPU 62*a* executes a predetermined process on the print data to calculate nozzle selection data (drive pulse selection data SI&SP) regarding which nozzle emits the liquid jet or how much liquid jet is to be emitted, and outputs the drive signals and the control signals to the feed roller motor driver 63, the head driver 65, and the electric motor driver 66, respectively, based on the print data, drive pulse selection data SI &S P, and input data from various sensors. In accordance with these control signals, the feed roller motor 17 and the electric motor 7 operate individually, thereby executing feeding, conveying, and ejection of the print medium 1, and the printing process on the print medium. 1. It should be noted that the constituents inside the control section 62 are electrically connected to each other via a bus not shown in the drawings.

Figure 4:
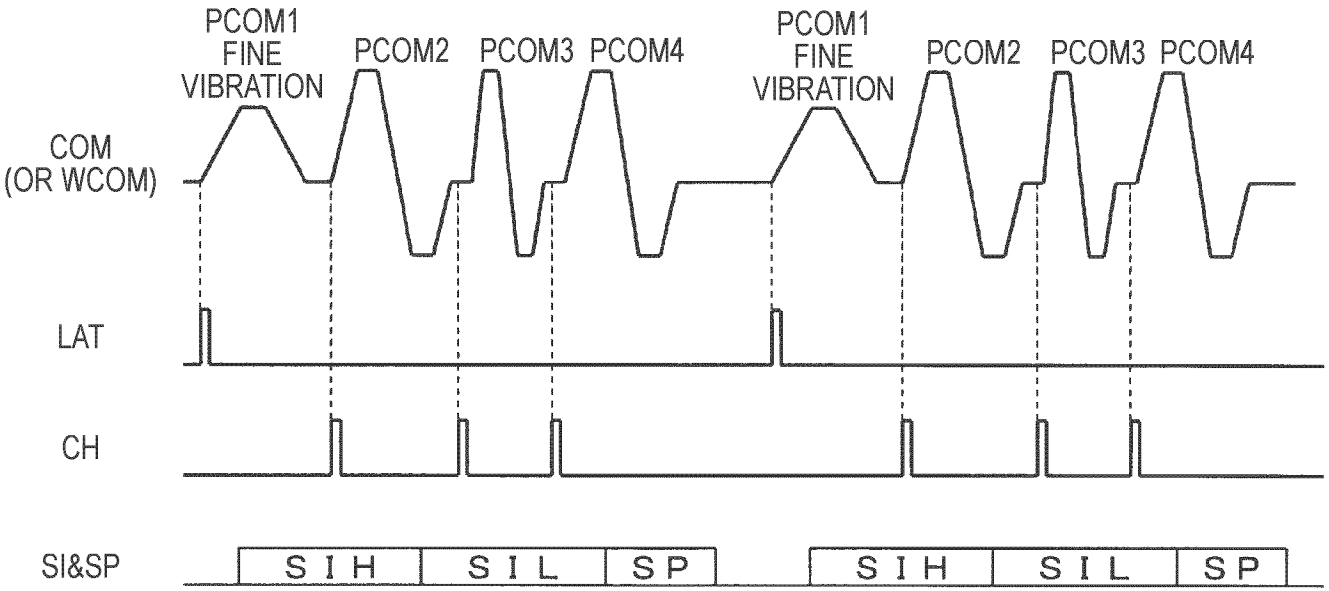
FIG. 4 is an explanatory diagram for a drive signal for driving actuators in the liquid jet head.

FIG. 4 shows an example of the drive signal COM supplied from the control apparatus of the printing apparatus according to the first embodiment to the liquid jet heads 2, and for driving actuators 22 each formed of a piezoelectric element. In the first embodiment, it is assumed that the signal has the voltage varying around a midpoint voltage. The drive signal COM is output from the drive circuit built in the head driver 65 to the liquid jet head 2, and is obtained by joining drive pulses PCOM, which are unit drive signals for driving the actuator 22 to emit a liquid jet, in a time-series manner. The rising portion of each of the drive pulses PCOM corresponds to the stage of expanding the capacity of the cavity (pressure chamber) communicating the nozzle to pull in the liquid (it can be said that the meniscus is pulled in considering the emission surface of the liquid), and the falling portion of the drive pulse PCOM corresponds to the stage of reducing the capacity of the cavity to push out the liquid (it can be said that the meniscus is pushed out considering the emission surface of the liquid), as the result of pushing out the liquid, the liquid jet is emitted from the nozzle.

By variously modifying the gradient of increase and decrease in voltage and the height of the drive pulse PCOM formed of trapezoidal voltage waves, the pull-in amount and the pull-in speed of the liquid, and the push-out amount and the push-out speed of the liquid can be modified, thus the amount of liquid jet can be varied to obtain the liquid dots with different sizes. Therefore, even in the case in which a plurality of drive pulses PCOM are joined in a time-series manner, it is possible to select the single drive pulse PCOM from the drive pulses to be supplied to the actuator to emit the liquid jet, or to select two or more drive pulses PCOM to be supplied to the actuator to emit the liquid jet two or more times, thereby obtaining the dots with various sizes. In other words, when the two or more liquid droplets land on the same position before the liquid is dried, it brings substantially the same result as emitting a larger amount of liquid jet thus the size of the dot can be enlarged.

By a combination of such technologies, it becomes possible to achieve multiple tone printing. A mechanism for selecting the drive signal with the drive pulse selection data SI&SP can be realized in such a manner as described in, for example, JP-A-2003-1824. It should be noted that a drive pulse PCOM1 shown in the left end of FIG. 4 is only for pulling in the liquid without pushing out the liquid. This is called a fine vibration, and is used, for example, for preventing thickening in the nozzle without emitting the liquid jet.

From the control apparatus shown in FIG. 3 to each of the liquid jet heads 2, as the control signals, there are input drive pulse selection data SI&SP for selecting the nozzle to emit the liquid jet and determining the coupling timing of the actuator 22 such as a piezoelectric element to the drive signal COM based on the print data, a latch signal LAT and a channel signal CH for coupling the drive signals COM and the actuators 22 of the liquid jet head 2 to each other based on the drive pulse selection data SI&SP after the nozzle selection data is input to all of the nozzles, and a clock signal SCK for transmitting the drive pulse selection data SI&SP to the liquid jet head 2 as a serial signal. It should be noted that it hereinafter assumed that the minimum unit of the drive signal for driving the actuator 22 is the drive pulse PCOM, and the entire signal having the drive pulses PCOM joined with each other in a time-series manner is described as the drive signal COM. In other words, output of a string of drive signal COM is started in response to the latch signal LAT, and the drive pulse PCOM is output in response to each channel signal CH.

Figure 5:
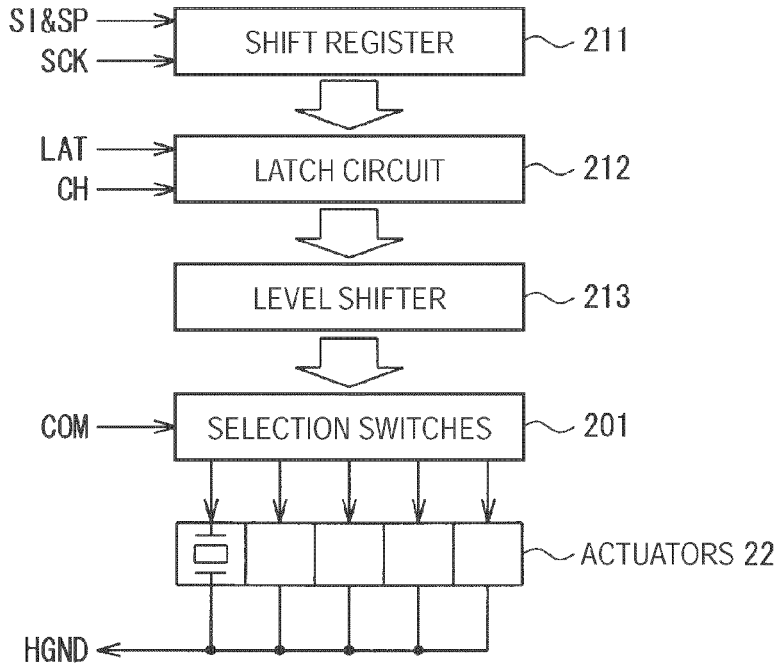
FIG. 5 is a block diagram of a switching controller.

FIG. 5 shows a specific configuration of a switching controller, which is built in the liquid jet head 2 in order for supplying the actuator 22 with the drive signal COM (the drive pulse PCOM). The switching controller is configured including a shift register 211 for storing the drive pulse selection data SI&SP for designating the actuator 22 such as a piezoelectric element corresponding to the nozzle from which the liquid jet is to be emitted, a latch circuit 212 for temporarily storing the data of the shift register 211, a level shifter 213 for executing level conversion on the output of the latch circuit 212 and supplying it to selection switches 201, thereby coupling the drive signal COM to the actuator 22 such as a piezoelectric element.

The drive pulse selection data SI&SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the latch signal LAT input thereto after the drive pulse selection data SI&SP corresponding to the number of nozzles has been stored in the shift register 211. The signals stored in the latch circuit 212 are converted by the level shifter 213 so as to have the voltage levels capable of switching on and off the selection switches 201 on the subsequent stage. This is because the drive signal COM has a high voltage compared to the output voltage of the latch circuit 212, and the operating voltage range of the selection switches 201 is also set to be higher in accordance therewith. Therefore, the actuator 22 such as a piezoelectric element, the selection switch 201 of which is closed by the level shifter 213, is coupled to the drive signal COM (the drive pulse PCOM) at the coupling timing of the drive pulse selection data SI&SP.

Further, after the drive pulse selection data SI&SP of the shift register 211 is stored in the latch circuit 212, the subsequent print information is input to the shift register 211, and the stored data of the latch circuit 212 is sequentially updated in sync with the liquid jet emission timing. It should be noted that a reference symbol HGND shown in FIG. 5 denotes the ground terminal for the actuators 22 such as the piezoelectric elements. Further, according to the selection switch 201, even after the actuator 22 such as the piezoelectric element is separated from the drive signal COM (the drive pulse PCOM), the input voltage of the actuator 22 is maintained at the voltage applied thereto immediately before it is separated.

Figure 6:
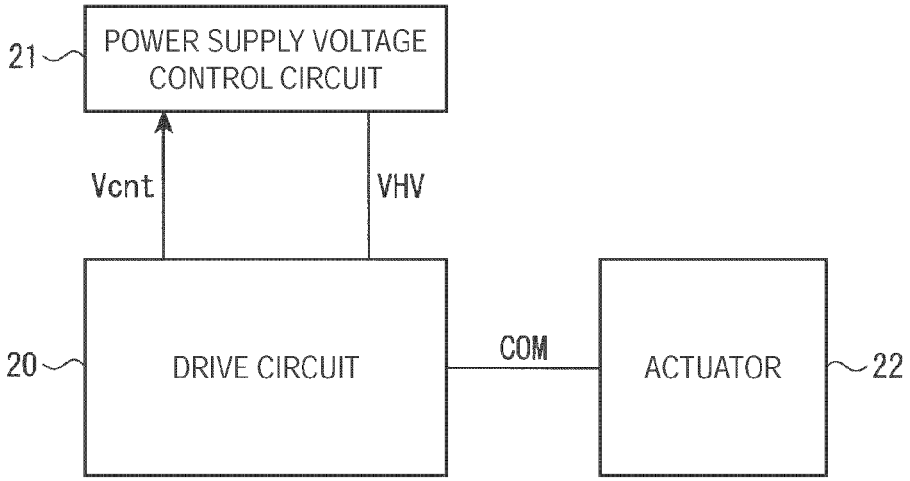
FIG. 6 is a block diagram of a vicinity of a drive circuit built in a head driver shown in FIG. 1.

FIG. 6 shows a drive circuit 20 built in the head driver 65 in outline. Although the drive circuit 20 is for outputting the drive signal COM towards the actuator 22 as described above, similarly in the head driver 65, there are built the drive circuit 20, specifically a power supply voltage control circuit 21 for controlling the power supply voltage to the drive signal COM, and with regard to the embodiments on and after the first embodiment, the supply voltage control circuit 21 controls a charge source power supply voltage VHV to the actuator 22 formed of a piezoelectric element as a charge-discharge actuator. The power supply voltage control circuit 21 controls the charge source power supply voltage to the drive signal COM to a predetermined waveform voltage based on a reference signal Vcnt obtained from the drive circuit 20. The reference signal Vcnt is formed of such a signal as to have a high level in the case in which the drive signal COM shown in, for example, FIG. 4 is higher than a predetermined voltage when comparing the drive signal COM with the predetermined voltage set previously, and have a low level in the case in which it is lower than the predetermined voltage.

FIGS. 7A through 7D show specific configurations of the drive circuit 20. The drive circuits 20 shown in FIGS. 7A through 7D have the same configurations as each other, but are different from each other in the output source of the reference signal Vcnt described above. The drive circuit 20 is configured including a drive waveform generator 23 for generating a drive waveform signal WCOM of the digital potential data to be a basis for controlling driving of the actuator 22, a D/A converter 24 for analog-converting the drive waveform signal WCOM generated by the drive waveform generator 23, a power amplifier 26 for power-amplifying an analog drive waveform signal AWCOM obtained by the analog-conversion by the D/A converter 24, and a pre-driver circuit 25 for driving the power amplifier 26.

The drive waveform generator 23 reads in the drive waveform data stored in the memory not shown, converts it into a voltage signal, and then holds it for a predetermined sampling period, thereby outputting the drive waveform signal WCOM of the digital potential data. As the D/A converter 24, a typical digital-analog converter is used, and the D/A converter 24 converts the drive waveform signal WCOM of the digital potential data into the analog drive waveform signal AWCOM, and then output it. The pre-driver circuit 25 controls the base voltage of each transistor of the power amplifier 26 composed of a pair of transistors push-pull coupled to each other as described later, thereby reducing the base current of the charging transistor, which rises as the number of actuators coupled thereto varies. As the pre-driver circuit 25, what is described in JP-A-2004-306434 having been proposed by the present applicant can be applied, for example.

Figure 8:
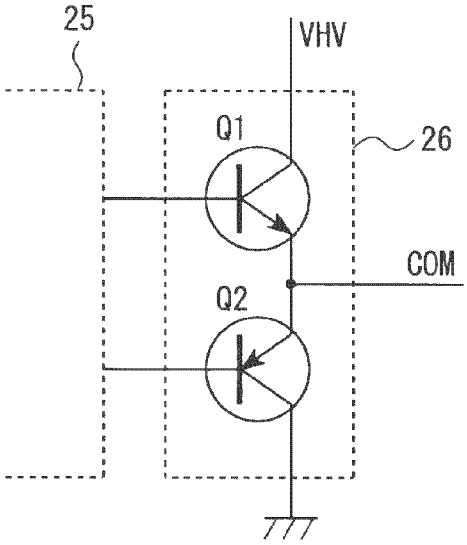
FIG. 8 is a block diagram of the power amplifier shown in FIGS. 7A through 7D.

As shown in FIG. 8, the power amplifier 26 is configured with a charging transistor Q1 and a discharging transistor Q2 push-pull coupled to each other, wherein the collector of the NPN charging transistor Q1, one of the transistors, is supplied with the charge source power supply voltage VHV from the power supply voltage control circuit 21, the emitter thereof is connected to the input side of the selection switch 201, and the base thereof is connected to one output of the pre-driver circuit 25, Further, the emitter of the PNP discharging transistor Q2, the other of the transistors, is connected to the input side of the selection switch 201, the collector thereof is grounded, and the base thereof is connected to the other output of the pre-driver circuit 25. In the transistor pair, the charging transistor Q1, one of the transistors, supplies electric charges to, namely charges, the actuator 22 as a capacitive load from the charge source power supply voltage VHV with the voltage waveform corresponding to the drive signal COM via the selection switch 201, and the discharging transistor Q2, the other of the transistors, discharges the actuator 22 as a capacitive load with the voltage waveform corresponding to the drive signal COM via the selection switch 201.

Figure 7A:
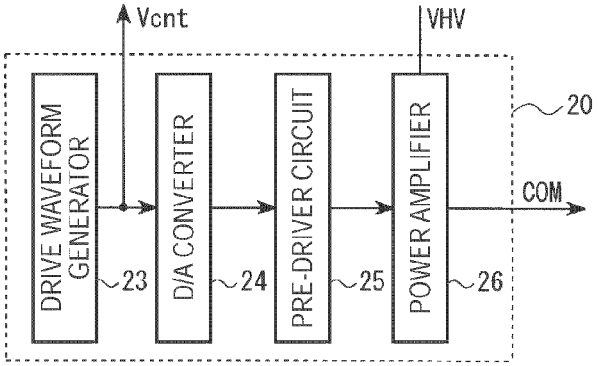
FIGS. 7A through 7D are block diagrams of the drive circuit shown in FIG. 6.
Figure 7B:
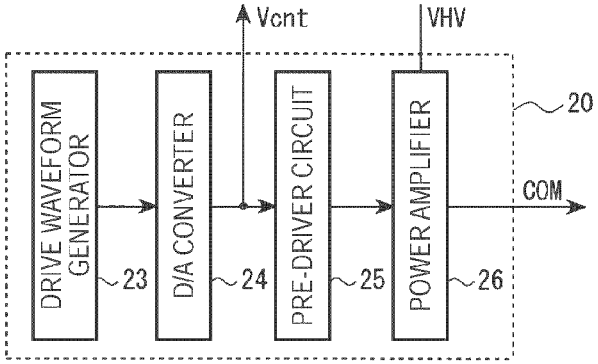
Figure 7C:
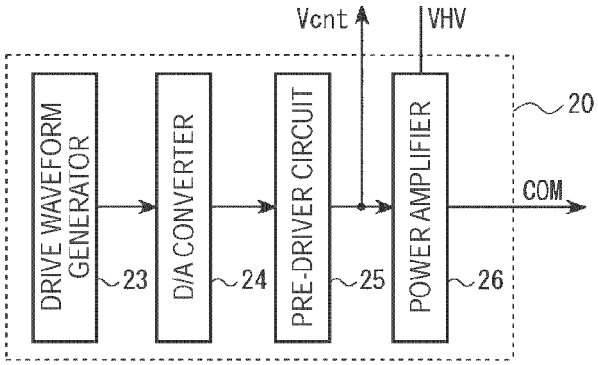
Figure 7D:
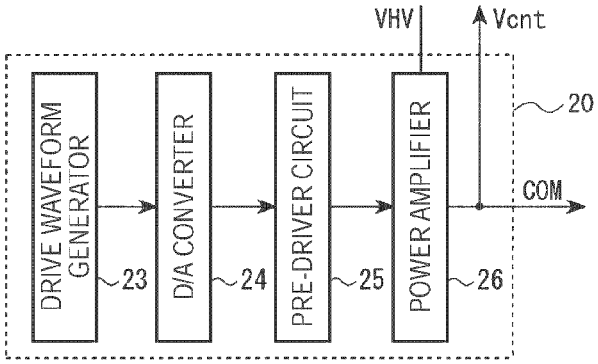
Figure 9A:
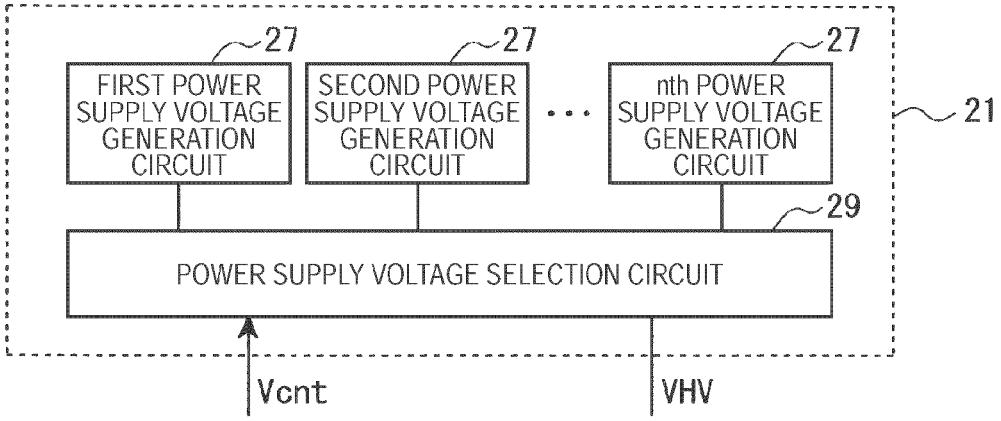
FIGS. 9A and 9B are block diagrams of the power supply voltage control circuit shown in FIG. 6.
Figure 9B:
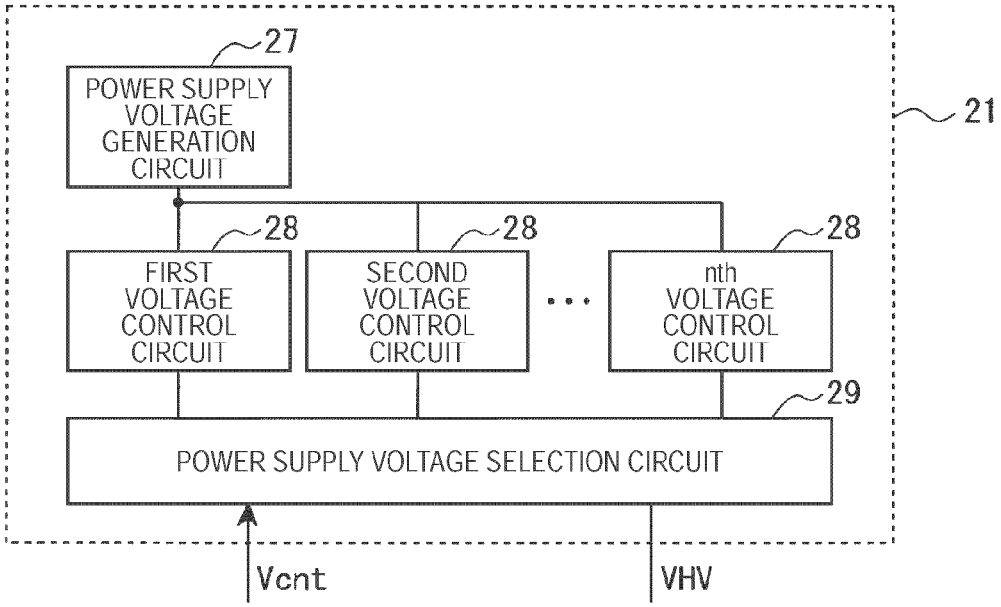

Further, the reference signal Vcnt is extracted from the drive waveform signal WCOM output from the drive waveform generator 23 in FIG. 7A, the reference signal Vcnt is extracted from the analog drive waveform signal AWCOM output from the D/A converter 24 in FIG. 7B, the reference signal Vcnt is extracted from the base voltage control signal output from the pre-driver circuit 25 in FIG. 7C, and the reference signal Vcnt is extracted from the drive signal COM output from the power amplifier 26 in FIG. 7D. The closer to the drive waveform generator 23 the output position of the reference signal Vcnt is, the better the switching of the power supply voltage described later can be performed at a timing corresponding to the original drive signal COM (or the drive waveform signal WCOM), and the closer to the power amplifier 26, the better the switching of the power supply voltage can be performed at the timing to which the actual drive signal COM is fed-back, FIGS. 9A and 9B are specific configuration examples of the power supply voltage control circuit 21, wherein FIG. 9A shows what is provided with n, namely first through nth, power supply voltage generation circuits 27 for generating a predetermined power supply voltage set previously, thus generating power supply voltages with the waveforms different from each other, FIG. 9B shows what is provided with n, namely first through nth, voltage control circuits 28 for controlling the power supply voltage generated by a single power supply voltage generation circuit 27 to be the power supply voltages with the waveforms set previously, thus outputting the power supply voltages with different waveforms therefrom, and a power supply voltage selection circuit 29 selects the power supply voltages with the different waveforms generated by the first through nth power supply voltage generation circuits 27 or the power supply voltages with the different waveforms output from the first through nth voltage control circuits 28 based on the reference signal Vcnt, and supplies the waveform voltage thus selected as the power supply voltage for the drive signal COM of the drive circuit 20.

These power supply voltage generation circuits 27 and these voltage control circuits 28 are for achieving substantially the same function, and in the case in which the power supply voltages belong to a direct-current voltage, for example, existing DC/DC converters and existing DC/AC converters can be applied thereto, and in the case in which the power supply voltages belong to a alternating-current voltage, existing AC/DC converters and existing AC/AC converters can be applied thereto.

Figure 10:
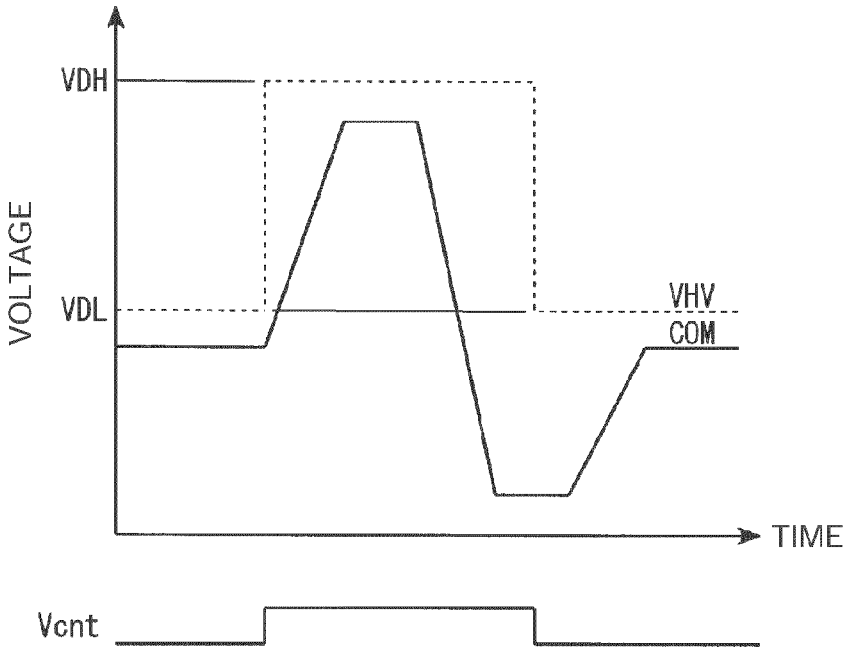
FIG. 10 is a waveform chart of the power supply voltage by the liquid jet apparatus shown in FIG. 1.

FIG. 10 is a voltage waveform chart of the charge source power supply voltage VHV of the present embodiment. The charge source power supply voltage VHV is obtained by switching two direct-current power supply voltages, which are output from the power supply voltage generation circuits 27 or the voltage control circuits 28 shown in FIGS. 9A and 9B, with the reference signal Vcnt, and specifically obtained by selecting a direct-current power supply voltage VDL with a lower voltage value when the reference signal Vcnt is in the low level, and selecting a direct-current power supply voltage VDH with a higher voltage value when the reference signal Vcnt is in the high level.

For example, the power supply voltage to the conventional drive signal COM is constantly fixed to the direct-current power supply voltage VDH with the higher voltage value shown in FIG. 10. Since the power supply voltage is applied as the charge source power supply voltage for charging the actuator: 22 via the charging transistor Q1, the difference in voltage with the drive signal COM causes a loss or heat generation when charging the actuator 22, namely when the drive signal COM rises. In the first embodiment, since it becomes possible to reduce the difference in voltage between the drive signal COM and the charge source power supply voltage VHV, it becomes possible to reduce the loss and the heat generation. It should be noted that as described in detail in the posterior stage, if it is arranged to reduce the difference in voltage between the drive signal COM and a discharge destination power supply voltage VLV in the destination to which the electric charge is discharged from the actuator 22 by controlling the discharge destination power supply voltage VLV using the similar configuration, it becomes possible to further reduce the loss and the heat generation accordingly.

As described above, according to the first embodiment, in the liquid jet apparatus provided with the plurality of nozzles provided to the liquid jet heads 2, the actuators 22 provided respectively to the nozzles, and the drive circuits 20 for applying the drive signals COM to the actuators 22, by including the power supply voltage control circuits 21 for controlling the charge source power supply voltage VHV to the drive signal COM to be the waveform voltage, set previously, based on the reference signal Vcnt obtained from the drive signal COM or the signal in the generation stage of the drive signal COM, it becomes possible to reduce the difference in voltage between the drive signal COM for charging the actuator 22 formed of a charge-discharge actuator or the drive signal COM for discharging the actuator 22 and the power supply voltage, thus it becomes possible to reduce the loss and the heat generation.

Further, since the drive circuit 20 is configured including the drive waveform generator 23 for generating the drive waveform signal WCOM forming a basis of the signal for controlling driving of the actuator 22, the D/A converter 24 for analog-converting the drive waveform signal WCOM generated by the drive waveform. generator 23, the power amplifier 26 for power-amplifying the analog drive waveform signal AWCOM obtained by the analog conversion by the D/A converter 24, and the pre-driver circuit 25 for driving the power amplifier 26, and generates the reference signal Vcnt based on the output signal of either one of these circuits, improvement inaccuracy of the drive signal COM and further reduction of the power consumption become possible.

Further, since the power supply voltage control circuit 21 is arranged to be configured including the plurality of power supply voltage generation circuits 27 for generating the plurality of power supply voltages or the plurality of voltage control circuits 28 for controlling the plurality of power supply voltages and the power supply voltage selection circuit 29 for selecting the power supply voltage output from the plurality of power supply voltage generation circuits 27 or the plurality of voltage control circuits 28, it becomes possible to further reduce the difference in voltage between the drive signal COM and the charge source power supply voltage VHV to further reduce the power consumption.

Further, since it is arranged that the power supply voltage generation circuits 27 are direct-current voltage power supply circuits or the voltage control circuits 28 are direct-current voltage control circuits, it is suitable for realizing the power supply voltage control circuit 21.

Figure 11:
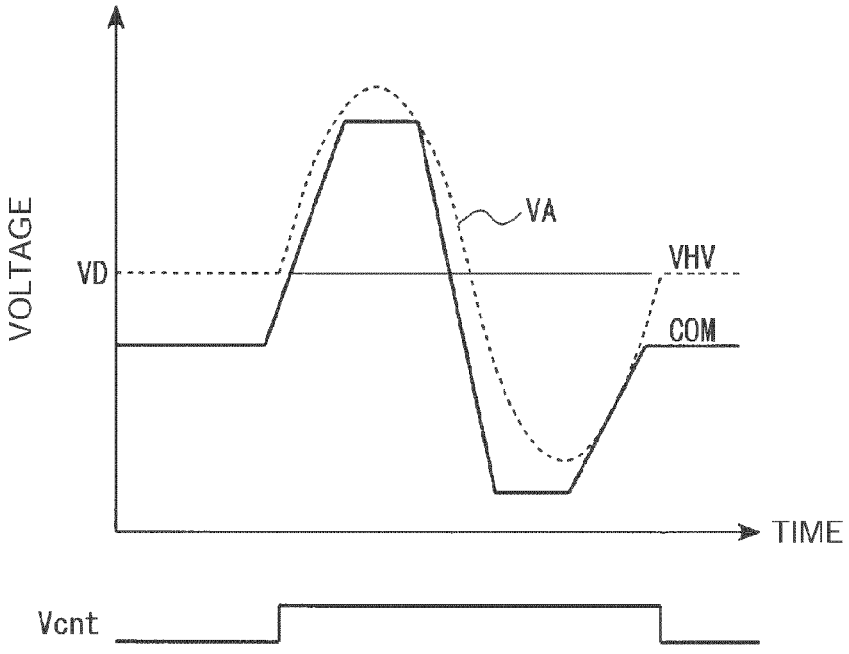
FIG. 11 is a waveform chart of the power supply voltage showing a second embodiment of the liquid jet apparatus of the invention.

A second embodiment of the liquid jet printing apparatus using the liquid jet apparatus of the invention will hereinafter be explained using FIG. 11, All of the schematic configuration, control apparatus, drive signals, switching controller, drive circuits, and power supply voltage control circuits of the liquid jet apparatus of the second embodiment are substantially the same as shown in FIGS. 1 through 9A and 9B of the first embodiment described above. FIG. 11 is a voltage waveform chart of the charge source power supply voltage VHV of the second embodiment. The charge source power supply voltage VHV is obtained by switching the direct-current power supply voltage and the alternating-current power supply voltage, which are output from the power supply voltage generation circuits 27 or the voltage control circuits 28 shown in FIGS. 9A and 9B, with the reference signal Vcnt, and specifically obtained by selecting a direct-current power supply voltage VD when the reference signal Vcnt is in the low level, and selecting an alternating-current power supply voltage VA when the reference signal Vcnt is in the high level.

Also in the second embodiment, since it becomes possible to reduce the difference in voltage between the drive signal COM and the charge source power supply voltage VHV, it becomes possible to reduce the loss and the heat generation.

As described above, according to the second embodiment, since it is arranged that the power supply voltage generation circuits 27 are alternating-current voltage power supply circuits, or the voltage control circuits 28 are alternating-current voltage control circuits, it is suitable for realizing the power supply voltage control circuit 21, in addition to the advantage of the first embodiment.

Figure 12:
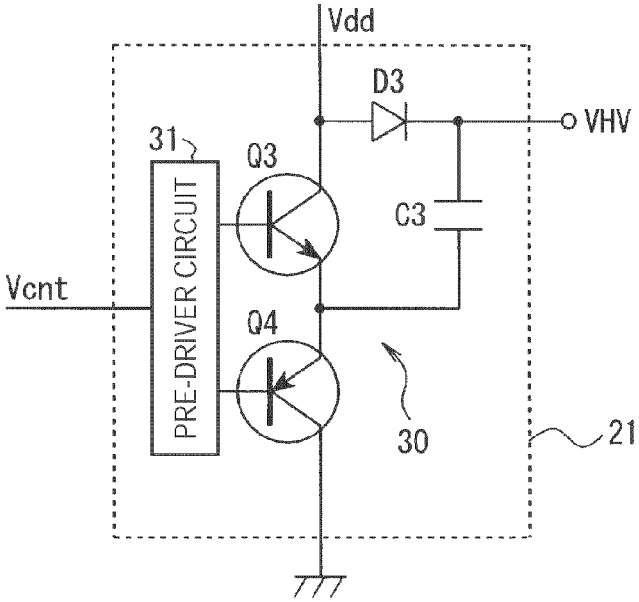
FIG. 12 is a block diagram of the power supply voltage control circuit showing a third embodiment of the liquid jet apparatus of the invention.

A third embodiment of the liquid jet printing apparatus using the liquid jet apparatus of the invention will hereinafter be explained using FIGS. 12 and 13. All of the schematic configuration, control apparatus, drive signals, switching controller, and drive circuits of the liquid jet apparatus of the third embodiment are substantially the same as shown in FIGS. 1 through 8 of the first embodiment described above. FIG. 12 shows a configuration of the power supply voltage control circuit 21 of the present embodiment, which is provided with a bootstrap circuit 30, The bootstrap circuit 30 is composed of a charging transistor Q3 for charging a capacitor C3 and a discharging transistor Q4 for discharging the capacitor C3 push-pull coupled to each other, wherein the collector of the NPN charging transistor Q3, one of the transistors, is supplied with a power supply voltage Vdd, the emitter thereof is connected to the capacitor C3, and the base thereof is connected to one output of a bootstrapping pre-driver circuit 31, Further, the emitter of the PNP discharging transistor Q4, the other of the transistors, is connected to the capacitor C3, the collector thereof is grounded, and the base thereof is connected to the other output of the bootstrapping pre-driver circuit 31. Between the power supply voltage Vdd and the output of the power supply voltage control circuit 21, there is inserted a diode D3 for preventing back-flow.

In the bootstrap circuit 30, the capacitor C3 is charged in the condition in which the discharging transistor Q4 i5 switched on, and the charging transistor Q3 is switched off, and after charging the capacitor C3, the charge source power supply voltage VHV can be doubled of the power supply voltage Vdd in the condition in which the discharging transistor Q4 is switched off, and the charging transistor Q3 is switched on.

Figure 13:
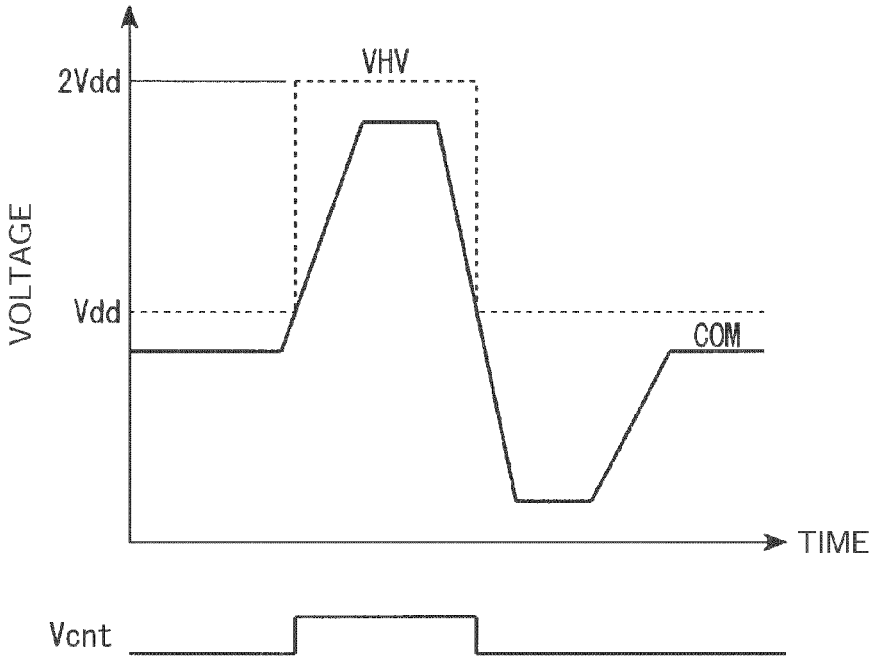
FIG. 13 is a waveform chart of the power supply voltage by the liquid jet apparatus shown in FIG. 12.

FIG. 13 is a voltage waveform chart of the charge source power supply voltage VHV of the third embodiment, The charge source power supply voltage VHV is obtained by switching the base current of the charging transistor Q3, discharging transistor Q4 of the bootstrap circuit 30 with the reference signal Vcnt, and specifically, the charging transistor Q3 is switched off to set the charge source power supply voltage VHV to be the power supply voltage Vdd when the reference signal Vcnt is in the low level, and the charging transistor Q3 is switched on to set the charge source power supply voltage VHV to be doubled of the power supply voltage Vdd when the reference signal Vcnt is in the high level. Also in the third embodiment, since it becomes possible to reduce the difference in voltage between the drive signal COM and the charge source power supply voltage VHV, becomes possible to reduce the loss and the heat generation.

As described above, according to the third embodiment, since it is arranged that the power supply voltage control circuit 21 is configured with the power supply circuit capable of stepping up the charge source power supply voltage VHV with the bootstrap circuit 30, and the stepping up of the charge source power supply voltage VHV by the bootstrap circuit 30 is controlled by the reference signal Vcnt, it is suitable for realizing the power supply voltage control circuit 21, and it becomes possible to obtain the higher charge source power supply voltage VHV to the drive signal COM using the lower power supply voltage Vdd, in addition to the advantage of the first embodiment.

Figure 14:
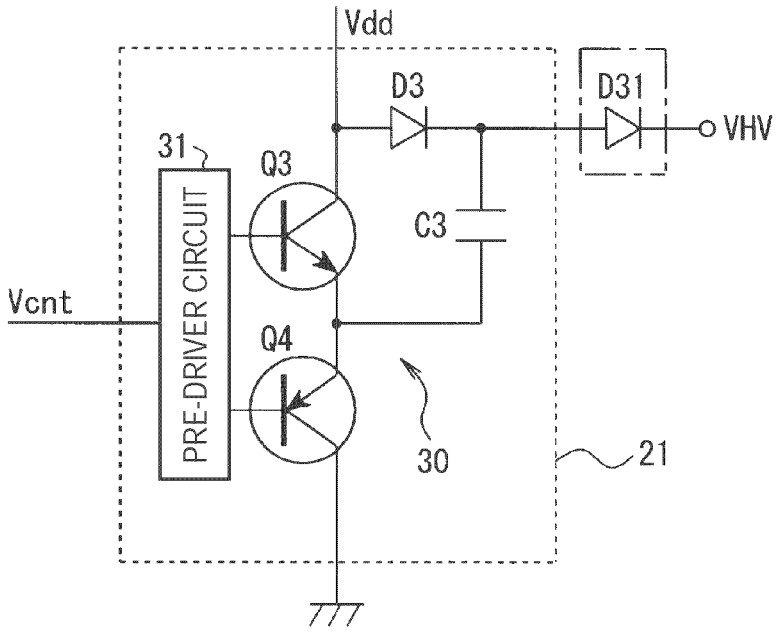
FIG. 14 is a block diagram of the power supply voltage control circuit showing a fourth embodiment of the liquid jet apparatus of the invention.

A fourth embodiment of the liquid jet printing apparatus using the liquid jet apparatus of the invention will hereinafter be explained using FIGS. 14 and 15. All of the schematic configuration, control apparatus, drive signals, switching controller, and drive circuits of the liquid jet apparatus of the fourth embodiment are substantially the same as shown in FIGS. 1 through 8 of the first embodiment described above. FIG. 14 shows the power supply voltage control circuit 21 of the fourth embodiment. The power supply voltage control circuit 21 of the fourth embodiment is similar to the power supply voltage control circuit shown in FIG. 12 of the third embodiment, and equivalent constituents are denoted with equivalent reference symbols, and the detailed description thereof will be omitted. In the power supply voltage control circuit 21 of the fourth embodiment, a diode D31 for preventing back-flow is further provided on the output side of the bootstrap circuit 30

Figure 15:
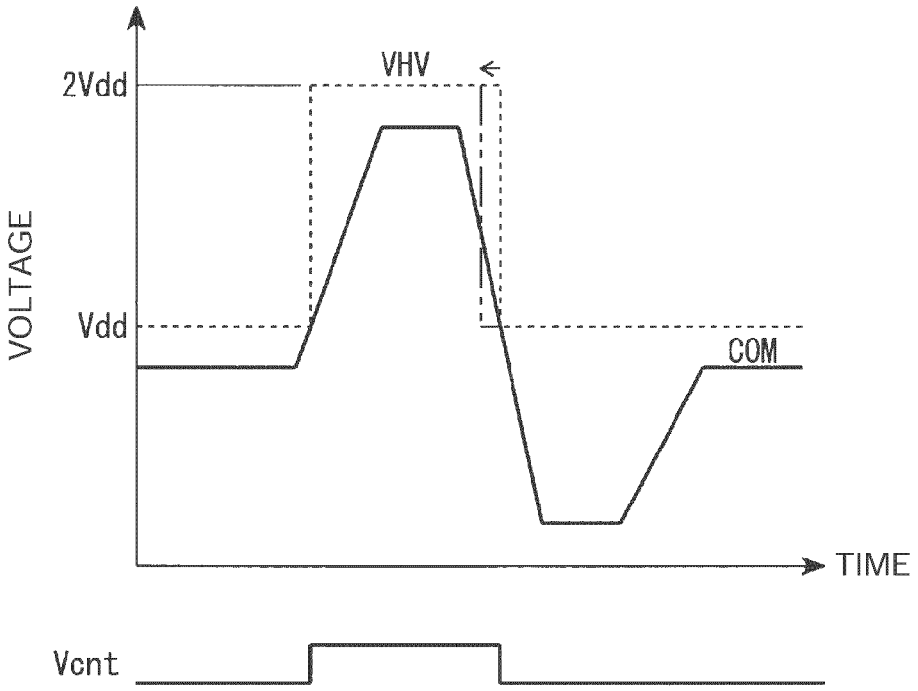
FIG. 15 is a waveform chart of the power supply voltage by the liquid jet apparatus shown in FIG. 14.

Although the voltage waveform chart of the charge source power supply voltage VHV of the fourth embodiment shown in FIG. 15 is basically the same as the voltage waveform chart shown in FIG. 13 of the third embodiment, in the case in which the diode D31 on the output side of the bootstrap circuit 30 is eliminated, the drive signal COM varies in accordance with the charge source power supply voltage VHV, in such a manner that the voltage of the drive signal COM rapidly drops in accordance with the charge source power supply voltage VHV (specifically, electric charge is discharged from the actuator 22 as a charge-discharge actuator) when the charge source power supply voltage VHV falls at a timing earlier than a predetermined timing as illustrated with the chain double-dashed line, In contrast, by disposing the diode D31 for preventing back-flow on the output side of the bootstrap circuit 30 as in the fourth embodiment, the discharge of the electric charge from the actuator 22 as a charge-discharge actuator can be prevented, thus the variation in the drive signal COM can be suppressed and prevented.

As described above, according to the fourth embodiment, since the diode D31 for preventing back-flow is disposed on the output side of the bootstrap circuit 30, the waveform of the drive signal COM can be maintained.

Figure 16:
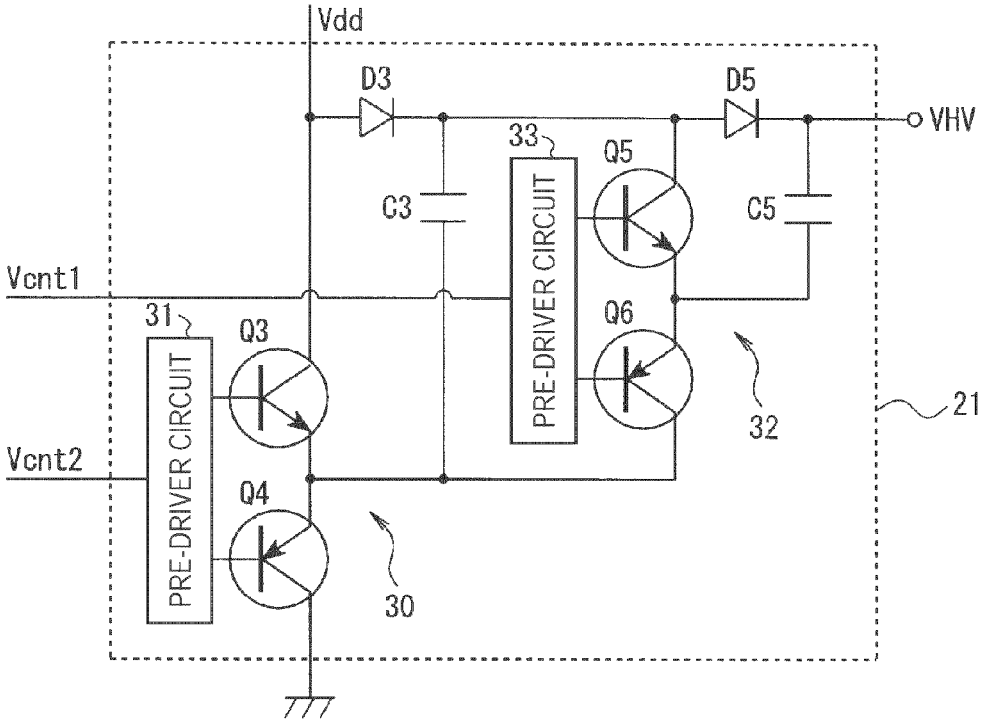
FIG. 16 is a block diagram of the power supply voltage control circuit showing a fifth embodiment of the liquid jet apparatus of the invention.

A fifth embodiment of the liquid jet printing apparatus using the liquid jet apparatus of the invention will hereinafter be explained using FIGS. 16 and 17. All of the schematic configuration, control apparatus, drive signals, switching controller, and drive circuits of the liquid jet apparatus of the fifth embodiment are substantially the same as shown in FIGS. 1 through 8 of the first embodiment described above. FIG. 16 shows the power supply voltage control circuit 21 of the fifth embodiment. The power supply voltage control circuit 21 of the fifth embodiment is similar to the power supply voltage control circuit shown in FIG. 12 of the third embodiment, and equivalent constituents are denoted with equivalent reference symbols, and the detailed description thereof will be omitted. In the power supply voltage control circuit 21 of the fifth embodiment, another stage of bootstrap circuit 32 is disposed on the output side of the bootstrap circuit 30 of the third embodiment.

Among these bootstrap circuits, assuming that the bootstrap circuit 32 on the output side is an anterior stage bootstrap circuit, and the bootstrap circuit 30 on the input side is a posterior stage bootstrap circuit, similarly to the posterior stage bootstrap circuit 30, the anterior stage bootstrap circuit 32 is also composed of a charging transistor Q5 for charging a capacitor C5 and a discharging transistor Q6 for discharging the electric charge of the capacitor C5 push-pull coupled to each other, and the collector of the NPN charging transistor Q5, one of the transistors, is supplied with an output terminal of the posterior stage bootstrap circuit 30, the emitter thereof is connected to the capacitor C5, and the base thereof is connected to one output of an anterior bootstrapping pre-driver circuit 33.

Further, the emitter of the PNP discharging transistor Q6, the other of the transistors, is connected to the capacitor C5, the collector thereof is connected to the emitter of the discharging transistor Q4 of the posterior stage bootstrap circuit 30, and the base thereof is connected to the other output of the anterior stage bootstrapping pre-driver circuit 31. Between the output terminal of the posterior stage bootstrap circuit 30 and the output of the power supply voltage control circuit 21, there is inserted a diode D5 for preventing back-flow.

Since the posterior stage bootstrap circuit 30 has the output voltage doubled of the power supply voltage Vdd in the condition in which the discharging transistor Q4 is switched off, and the charging transistor Q3 is switched on, by further switching off the discharging transistor Q6 of the anterior stage bootstrap circuit 32, and switching on the charging transistor Q5 thereof, the charge source power supply voltage VHV can be tripled of the power supply voltage Vdd.

Figure 17:
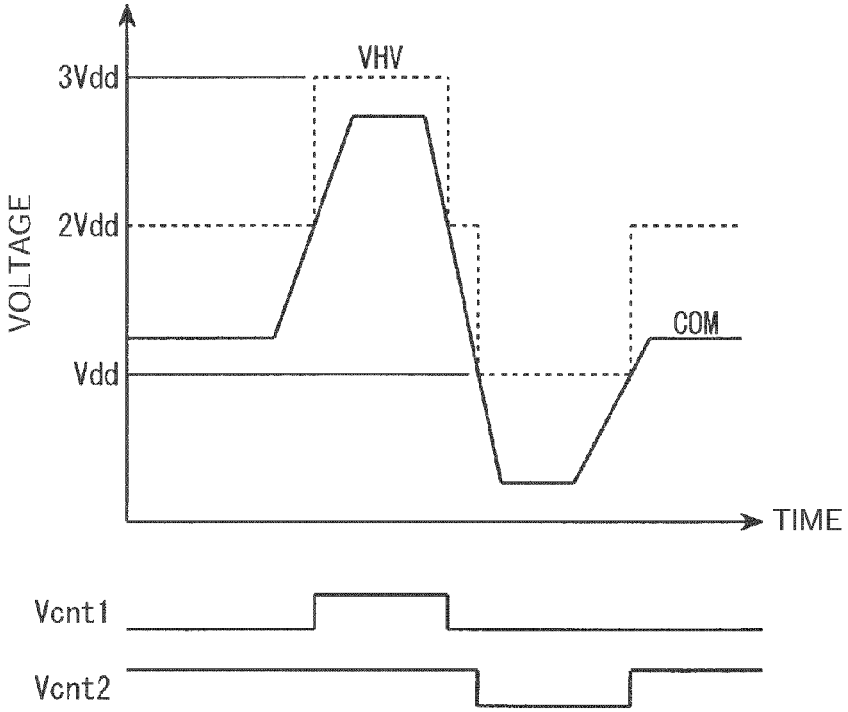
FIG. 17 is a waveform chart of the power supply voltage by the liquid jet apparatus shown in FIG. 16.

FIG. 17 is a voltage waveform chart of the charge source power supply voltage VHV of the fifth embodiment, The charge source power supply voltage VHV is obtained by switching the base current of the charging transistor Q5, discharging transistor Q6 of the anterior stage bootstrap circuit 32 with a first reference signal Vcnt1, and switching the base current of the charging transistor Q3, discharging transistor Q4 of the posterior stage bootstrap circuit 30 with a second reference signal Vcnt2, and specifically, when the first reference signal Vcnt1 and the second reference signal Vcnt2 are both in the low level, the charging transistor Q5 of the anterior stage bootstrap circuit 32 and the charging transistor Q3 of the posterior stage bootstrap circuit 30 are both switched off to set the charge source power supply voltage VHV to be the power supply voltage Vdd, when only the second reference signal Vcnt2 is in the high level, only the charging transistor Q3 of the posterior stage bootstrap circuit 30 switched on to set the charge source power supply voltage VHV to be doubled of the power supply voltage Vdd, and when the first reference signal Vcnt1 and the second reference signal Vcnt2 are both in the high level, the charging transistor Q5 of the anterior stage bootstrap circuit 32 and the charging transistor Q3 of the posterior bootstrap circuit 30 are both switched on to set the charge source power supply voltage VHV to be tripled of the power supply voltage Vdd.

Also in the fifth embodiment, since it becomes possible to reduce the difference in voltage between the drive signal COM and the charge source power supply voltage VHV, it becomes possible to reduce the loss and the heat generation.

As described above, according to the fifth embodiment, a higher charge source power supply voltage VHV to the drive signal COM can be obtained using a much lower power supply voltage Vdd in addition to the advantage of the third embodiment.

It should be noted that it is also possible to dispose the diode D31 for preventing back-flow on the output side of the anterior stage bootstrap circuit 32 of the power supply voltage control circuit 21 of the fifth embodiment similarly to the case of the fourth embodiment.

Figure 18:
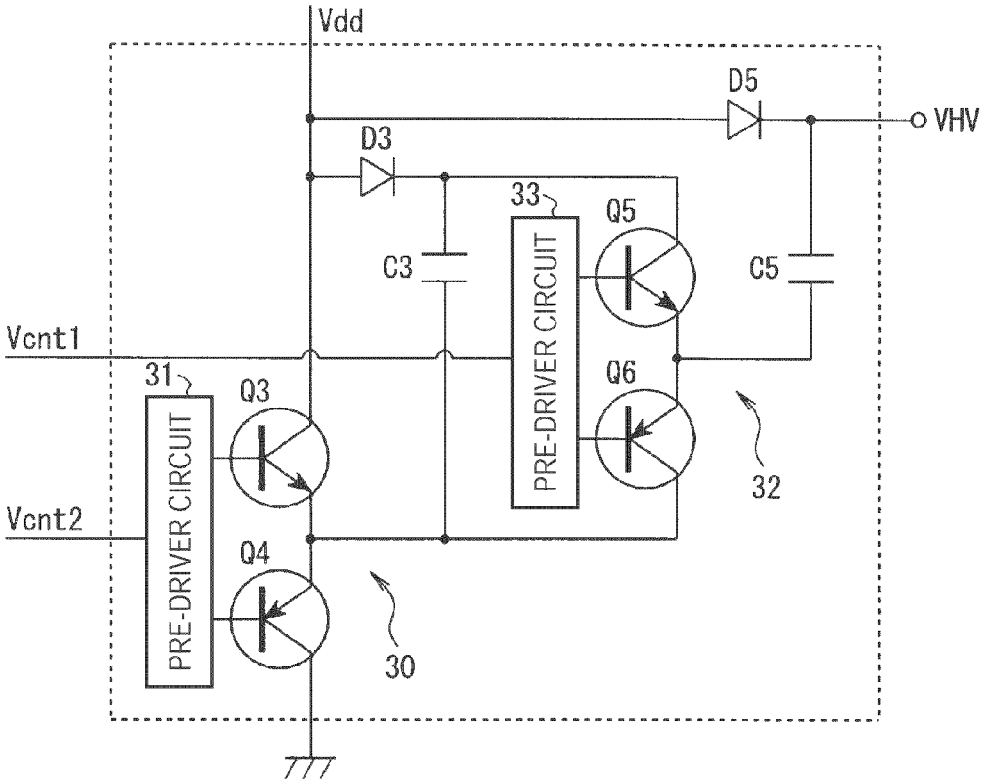
FIG. 18 is a block diagram of another example of the power supply voltage control circuit shown in FIG. 16.

Further, it is also possible to connect the back-flow preventing diodes D3, D5 to the power supply voltage Vdd in parallel to each other as shown in FIG. 18. If the back-flow preventing diodes D3, D5 are connected in series as shown in FIG. 16, the input voltage to the anterior stage bootstrap circuit 32 drops as much as the voltage drop in the back-flow preventing diode D3 on the input side. Although the voltage drop by the diode is extremely small, the input voltage to the anterior stage bootstrap circuit 32 still drops as much as the voltage drop, and therefore, in order for avoiding the voltage drop, it is possible to connect the back-flow preventing diodes D3, D5 to the power supply voltage Vdd in parallel to each other as shown in FIG. 18.

Figure 19:
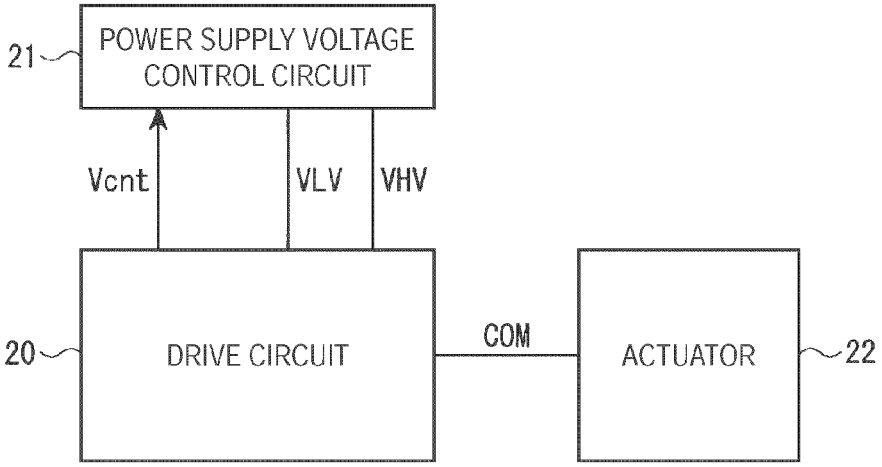
FIG. 19 is a block diagram of a vicinity of the drive circuit showing a sixth embodiment of the liquid jet apparatus of the invention.
Figure 20A:
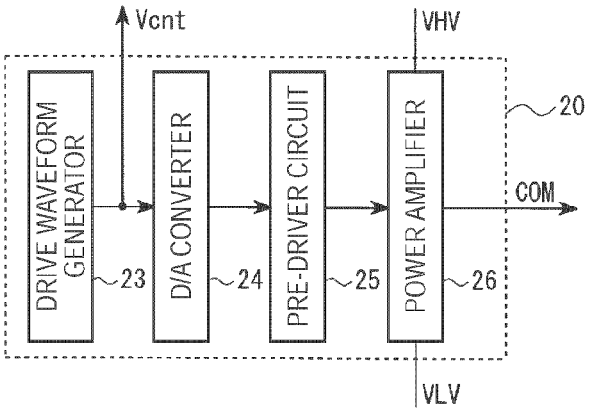
FIGS. 20A through 20D are block diagrams of the drive circuit shown in FIG. 19.
Figure 20B:
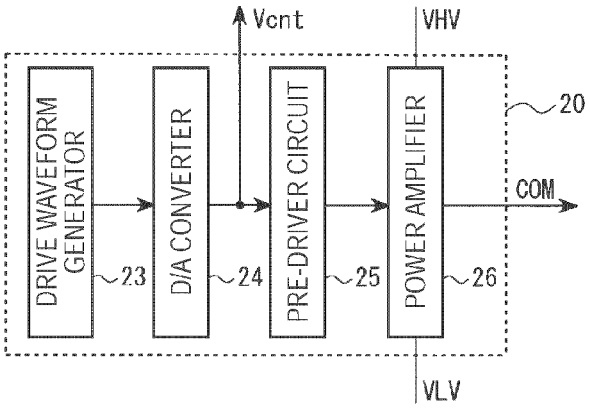
Figure 20C:
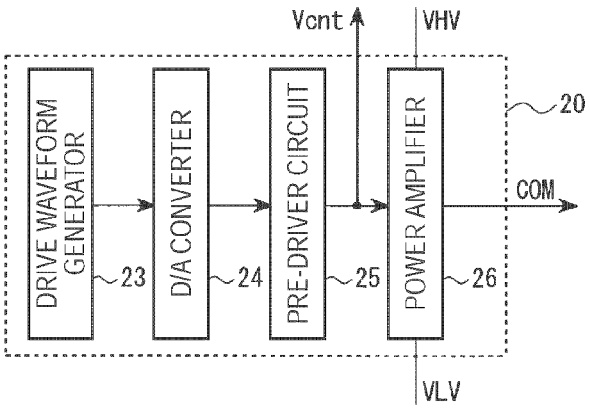
Figure 20D:
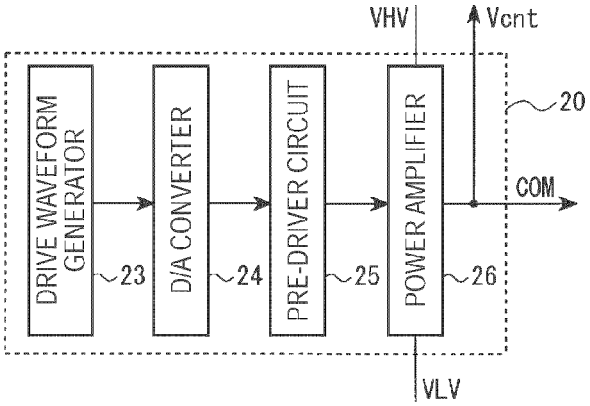

A sixth embodiment of the liquid jet printing apparatus using the liquid jet apparatus of the invention will hereinafter be explained. FIG. 19 shows a schematic configuration of the drive circuit 20 of the present embodiment. All of the embodiments on and after the sixth embodiment control not only the charge source power supply voltage VHV for charging the actuator 22 via the power amplifier 26, but also the discharge destination power supply voltage VLV for discharging the electric charge from the actuator 22 similarly via the power amplifier 26.

FIGS. 20A through 20D show specific configurations of the drive circuit 20. The drive circuit 20 of the sixth embodiment is also similar to the drive circuit of the first embodiment, and therefore, equivalent constituents are denoted with equivalent reference symbols, and the detailed description thereof will be omitted. FIGS. 20A through 20D are different in the output source of the reference signal Vcnt The reference signal Vcnt is extracted from the drive waveform signal WCOM output from the drive waveform generator 23 in FIG. 20A, the reference signal Vcnt is extracted from the analog drive waveform signal AWCOM output from the D/A converter 24 in FIG. 20B, the reference signal Vcnt is extracted from the base voltage control signal output from the pre-driver circuit 25 in FIG. 20C, and the reference signal Vcnt is extracted from the drive signal COM output from the power amplifier 26 in FIG. 20D. The effect caused by the difference in the output position of the reference signal Vcnt is substantially the same as in the first embodiment. It should be noted that, as described above, the power amplifier 26 shown in FIG. 21 is supplied with the charge source power supply voltage VHV and the discharge destination power supply voltage VLV controlled by the power supply voltage control circuit 21.

Figure 22A:
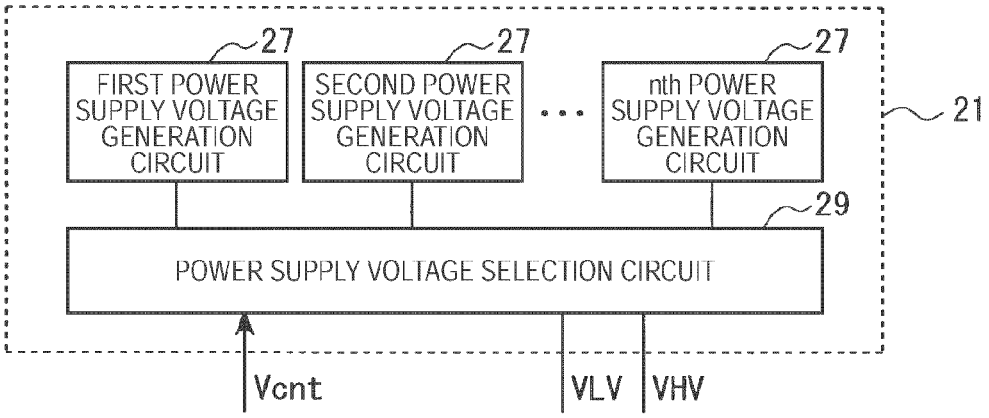
FIGS. 22A and 22B are block diagrams of the power supply voltage control circuit shown in FIG. 19.
Figure 22B:
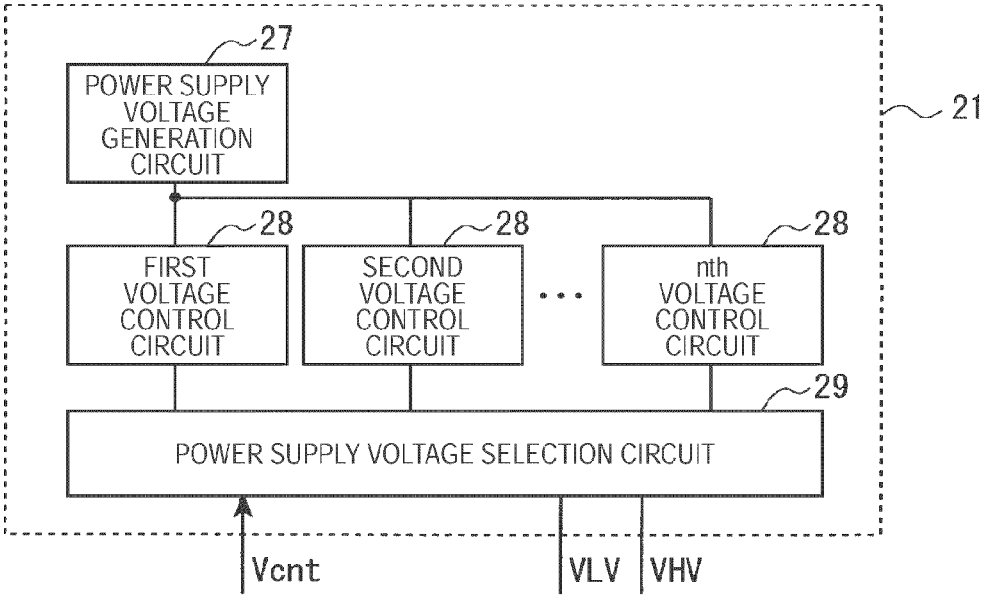

FIGS. 22A and 22B are specific configuration examples of the power supply voltage control circuit 21, wherein FIG. 22A shows what is provided with n, namely first through nth, power supply voltage generation circuits 27 for generating a predetermined power supply voltage set previously, thus generating power supply voltages with the waveforms different from each other, FIG. 22B shows what is provided with n, namely first through nth, voltage control circuits 28 for controlling the power supply voltage generated by a single power supply voltage generation circuit 27 to be the power supply voltages with the waveforms set previously, thus outputting the power supply voltages with different waveforms therefrom, and the power supply voltage selection circuit 29 selects the power supply voltages with the different waveforms generated by the first through nth power supply voltage generation circuits 27 or the power supply voltages with the different waveforms output from the first through nth voltage control circuits 28 based on the reference signal Vcnt, and supplies the waveform voltage thus selected as the power supply voltage for the drive signal COM of the drive circuit 20. In the sixth embodiment, the functions of the power supply voltage generation circuits 27 and the voltage control circuits 28 are the same as those of the first embodiment except the fact that they generate or control not only the charge source power supply voltages VHV but also the discharge destination power supply voltages VLV.

Figure 23:
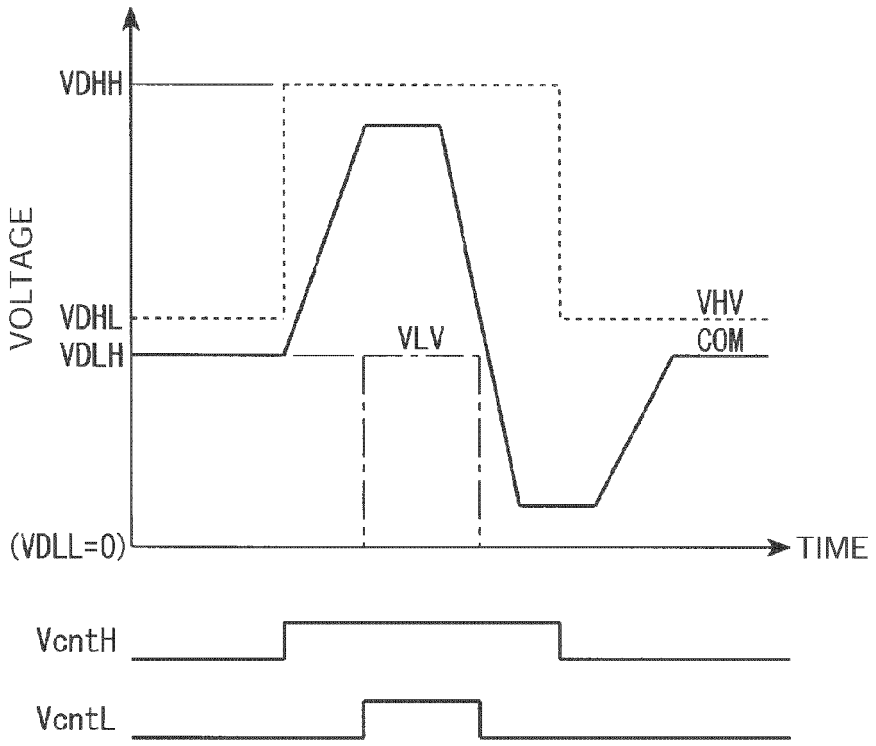
FIG. 23 is a waveform chart of the power supply voltage by the liquid jet apparatus shown in FIG. 19

FIG. 23 is a voltage waveform chart of the charge source power supply voltage VHV and the discharge destination power supply voltage VLV of the sixth embodiment. Among them, the charge source power supply voltage VHV is obtained by switching two direct-current power supply voltages output from the power supply voltage generation circuits 27 or the voltage control circuits 28 of FIG. 22A and FIG. 22B with a charge source reference signal VcntH, and specifically, it is arranged that a charge source direct-current power supply voltage VDHL with a lower voltage value is selected when the charge source reference signal VcntH is in the low level, a charge source direct-current power supply voltage VDHH with a higher voltage value is selected when the charge source reference signal VcntH is in the high level, a discharge destination direct-current power supply voltage VDLH with a lower voltage value is selected when a discharge destination reference signal VcntL is in the high level, and a discharge destination direct-current power supply voltage VDLL (=OV) with a high voltage value is selected when the discharge destination reference signal VcntL is in the low level.

In the power supply voltage to the conventional drive signal COM, the discharge destination power supply voltage VLV is constantly fixed to the ground voltage (=0V). Since the ground voltage is a voltage value for discharging from the actuator 22 via the discharging transistor Q2, the difference in voltage with the drive signal COM causes a loss or heat generation when discharging from the actuator 22, namely when the drive signal COM falls, In the sixth embodiment, since it becomes possible to reduce not only the difference in voltage between the drive signal COM and the charge source power supply voltage VHV, but also the difference in voltage between the drive signal COM and the discharge destination power supply voltage VLV, it becomes possible to reduce the loss and the heat generation.

As described above, according to the sixth embodiment, in the liquid jet apparatus provided with the plurality of nozzles provided to the liquid jet heads 2, the actuators 22 provided respectively to the nozzles, and the drive circuits 20 for applying the drive signals COM to the actuators 22, by including the power supply voltage control circuits 21 for controlling the charge source power supply voltage VHV, discharge destination power supply voltage VLV to the drive signal COM to be the waveform voltage, set previously, based on the reference signal Vcnt obtained from the drive signal COM or the signal in the generation stage of the drive signal COM, it becomes possible to reduce the difference in voltage between the drive signal COM for charging the actuator 22 formed of a charge-discharge actuator or the drive signal COM for discharging the actuator 22 and the power supply voltage, thus it becomes possible to reduce the loss and the heat generation in addition to the advantage of the first embodiment.

Further, since the power supply voltage control circuit 21 is arranged to be configured including the plurality of power supply voltage generation circuits 27 for generating the plurality of power supply voltages or the plurality of voltage control circuits 28 for controlling the plurality of power supply voltages and the power supply voltage selection circuit 29 for selecting the power supply voltage output from the plurality of power supply voltage generation circuits 27 or the plurality of voltage control circuits 28, it becomes possible to further reduce the difference in voltage between the drive signal COM and the charge source power supply voltage VHV, discharge destination power supply voltage VLV to further reduce the power consumption.

Figure 24:
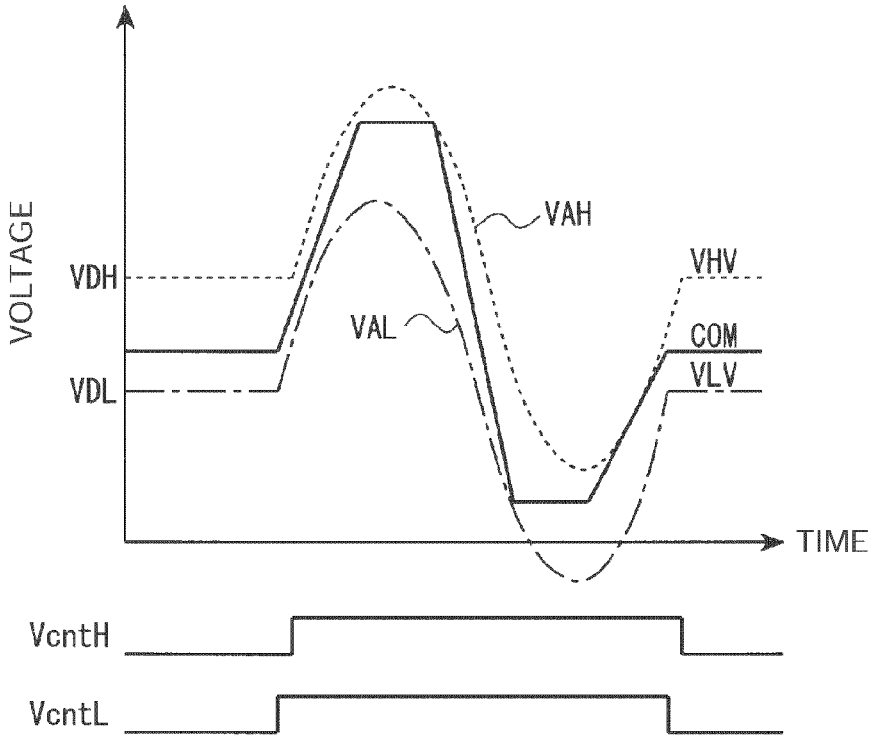
FIG. 24 is a waveform chart of the power supply voltage showing a seventh embodiment of the liquid jet apparatus of the invention.

A seventh embodiment of the liquid jet printing apparatus using the liquid jet apparatus of the invention will hereinafter be explained using FIG. 24. All of the schematic configuration, control apparatus, drive signals, and switching controller of the liquid jet apparatus of the seventh embodiment are substantially the same as shown in FIGS. 1 through 5 of the first embodiment described above, and drive circuits and power supply voltage control circuits thereof are substantially the same as shown in FIGS. 19 through 22A and 22B of the sixth embodiment described above. FIG. 24 is a voltage waveform chart of the charge source power supply voltage VHV and the discharge destination power supply voltage VLV of the seventh embodiment.

The charge source power supply voltage VHV and the discharge destination power supply voltage VLV are obtained by switching the direct-current power supply voltage and the alternating-current power supply voltage output from the power supply voltage generation circuits 27 or the voltage control circuits 28 shown in FIGS. 22A and 22B with the reference signals VcntH, VcntL, and specifically, it is arranged that a charge source direct-current power supply voltage VDH is selected when the charge source reference signal VcntH is in the low level, a charge source alternating-current power supply voltage VAH is selected when the charge source reference signal VcntH is in the high level, a discharge destination direct-current power supply voltage VDL is selected when the discharge destination reference signal VcntL is in the low level, and a discharge destination alternating-current power supply voltage VAL is selected when the discharge destination reference signal VcntL is in the high level. Also in the seventh embodiment, since it becomes possible to reduce the difference in voltage between the drive signal COM and the charge source power supply voltage VHV, it becomes possible to reduce the loss and the heat generation.

Figure 21:
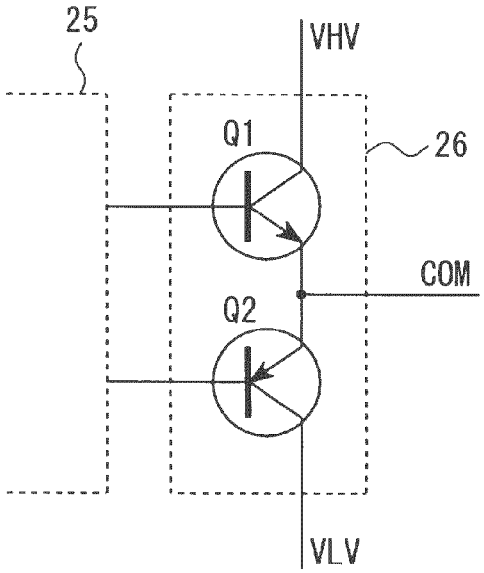
FIG. 21 is a block diagram of the power amplifier shown in FIGS. 20A through 20D.
Figure 25:
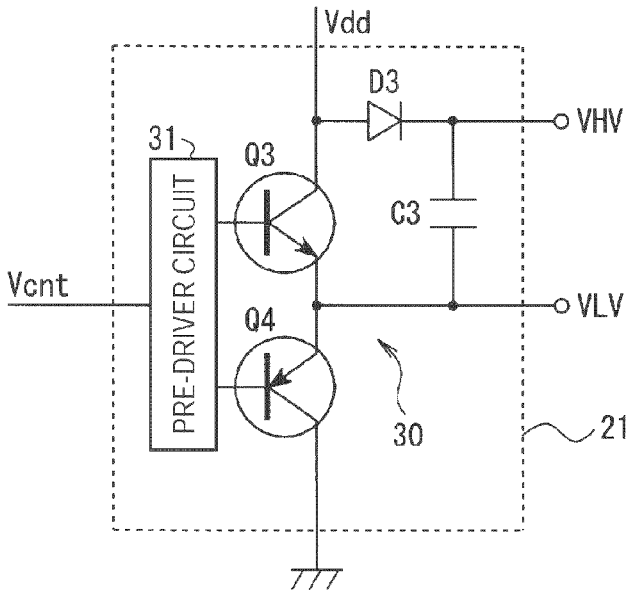
FIG. 25 is a block diagram of the power supply voltage control circuit showing an eighth embodiment of the liquid jet apparatus of the invention.

An eighth embodiment of the liquid jet printing apparatus using the liquid jet apparatus of the invention will hereinafter be explained using FIGS. 25 and 26. All of the schematic configuration, control apparatus, drive signals, and switching controller of the liquid jet apparatus of the eighth embodiment are substantially the same as shown in FIGS. 1 through 5 of the first embodiment described above, and drive circuits thereof are substantially the same as shown in FIGS. 19 through 21 of the sixth embodiment described above. FIG. 25 shows a configuration of the power supply voltage control circuit 21 of the eighth embodiment, which is substantially the same as what is shown in FIG. 12 of the third embodiment described above, wherein the charge source power supply voltage VHV is output from one of the both ends of the capacitor C3, which is connected to the power supply voltage Vdd, and the discharge destination power supply voltage VLV is output from the other of the both ends of the capacitor C3, which is connected to the emitter of the charging transistor Q3.

Figure 26:
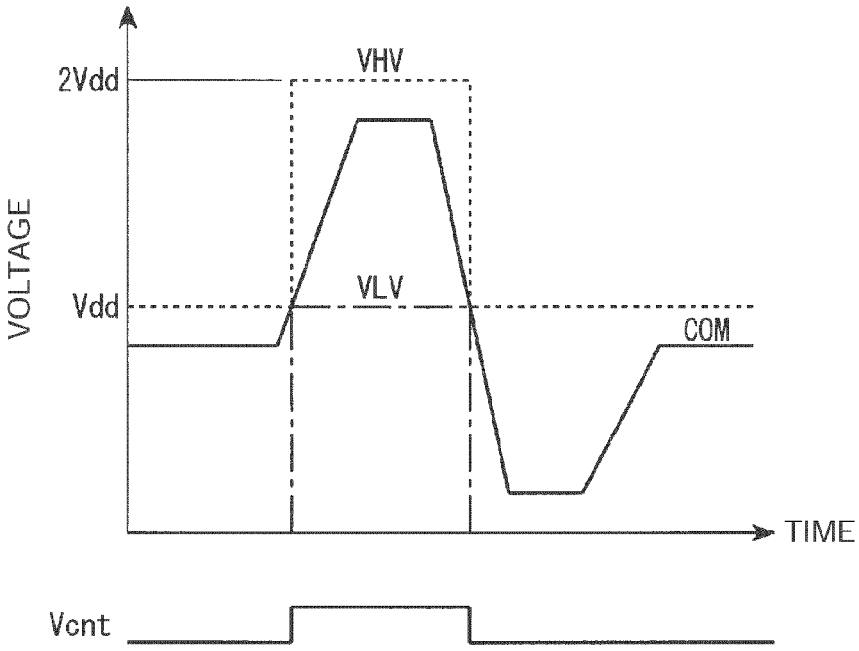
FIG. 26 is a waveform chart of the power supply voltage by the liquid jet apparatus shown in FIG. 25.

FIG. 26 is a voltage waveform chart of the charge source power supply voltage VHV and the discharge destination power supply voltage VLV of the eighth embodiment. The charge source power supply voltage VHV and the discharge destination power supply voltage VLV are obtained by switching the base current of the charging transistor Q3, discharging transistor Q4 of the bootstrap circuit 30 with the reference signal Vcnt, and specifically, the charging transistor Q3 is switched off to set the charge source power supply voltage VHV to be the power supply voltage Vdd and the discharge destination power supply voltage VLV to be OV when the reference signal Vcnt is in the low level, and the charging transistor Q3 is switched on to set the charge source power supply voltage VHV to be doubled of the power supply voltage Vdd and the discharge destination power supply voltage VLV to be the power supply voltage Vdd when the reference signal Vcnt is in the high level. Also in the eighth embodiment, since it becomes possible to reduce the difference in voltage between the drive signal COM and the charge source power supply voltage VHV and the discharge destination power supply voltage VLV, it becomes possible to reduce the loss and the heat generation.

Figure 27:
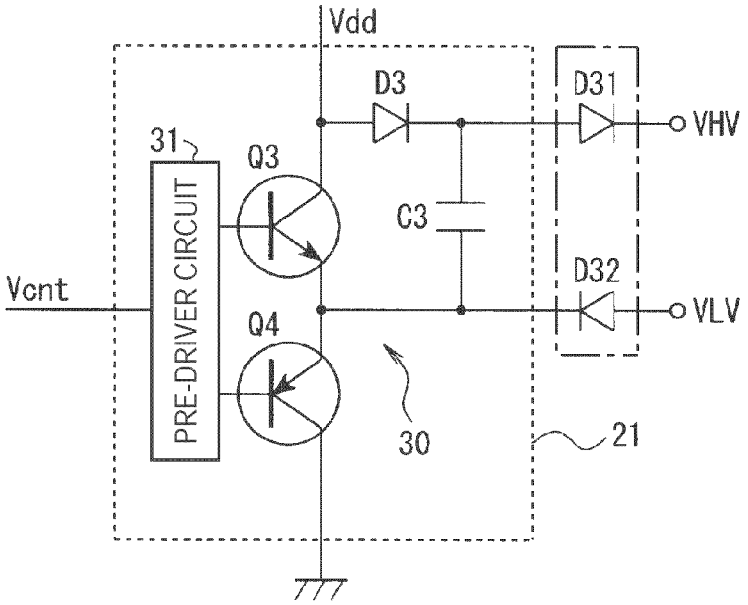
FIG. 27 is a block diagram of the power supply voltage control circuit showing a ninth embodiment of the liquid jet apparatus of the invention.

A ninth embodiment of the liquid jet printing apparatus using the liquid jet apparatus of the invention will hereinafter be explained using FIGS. 27 and 28. All of the schematic configuration, control apparatus, drive signals, and switching controller of the liquid jet apparatus of the ninth embodiment are substantially the same as shown in FIGS. 1 through 5 of the first embodiment described above, and drive circuits thereof are substantially the same as shown in FIGS. 19 through 21 of the sixth embodiment described above. FIG. 27 shows the power supply voltage control circuit 21 of the ninth embodiment. The power supply voltage control circuit 21 of the ninth embodiment is similar to the power supply voltage control circuit shown in FIG. 25 of the eighth embodiment, and equivalent constituents are denoted with equivalent reference symbols, and the detailed description thereof will be omitted. In the power supply voltage control circuit 21 of the ninth embodiment, diodes D31, D32 for preventing back-flow are further disposed on the output side of the bootstrap circuit 30.

Figure 28:
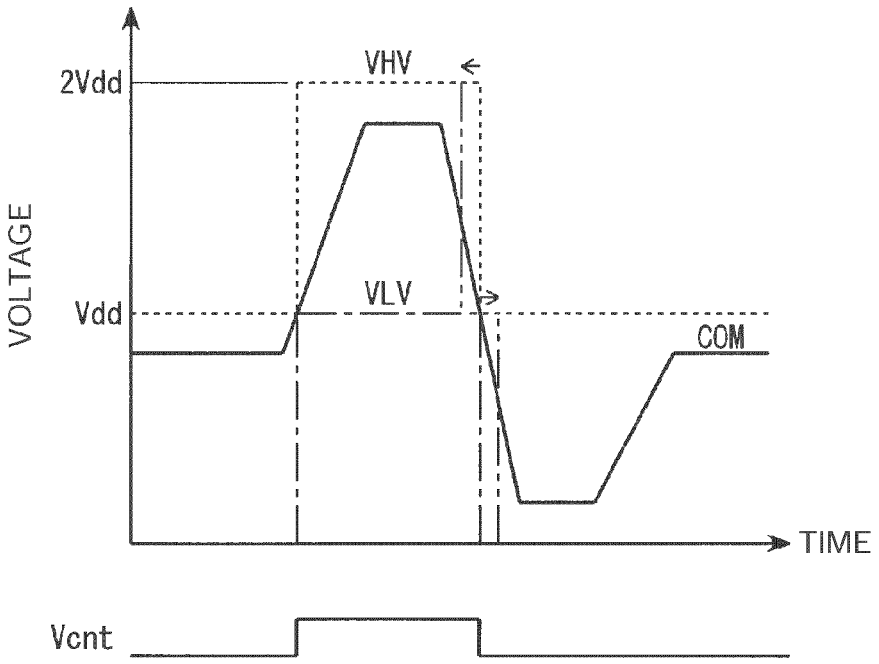
FIG. 28 is a waveform chart of the power supply voltage by the liquid jet apparatus shown in FIG. 27.

Although the voltage waveform chart of the charge source power supply voltage VHV and the discharge destination power supply voltage VLV of the ninth embodiment shown in FIG. 28 is basically the same as the voltage waveform chart shown in FIG. 26 of the eighth embodiment, in the case in which the diode D31 on the output side of the bootstrap circuit 30 is eliminated, the drive signal COM varies in accordance with the charge source power supply voltage VHV and the discharge destination power supply voltage VLV, in such a manner that the voltage of the drive signal COM rapidly drops in accordance with the charge source power supply voltage VHV (specifically, electric charge is discharged from the actuator 22 as a charge-discharge actuator) when the charge source power supply voltage VHV at a timing earlier than a predetermined timing as illustrated with the chain double-dashed line, and that the voltage of the drive signal COM rapidly rises in accordance with the discharge destination power supply voltage VLV (specifically, electric charge is charged to the actuator 22 as a charge-discharge actuator) when the discharge destination power supply voltage VLV falls at a timing later than the predetermined timing as illustrated with the chain double-dashed line.

In contrast, by disposing the diodes D31, D32 for preventing back-flow on the output side of the bootstrap circuit 30 as in the ninth embodiment, the discharge of the electric charge from the actuator 22 as a charge-discharge actuator and the charge of the electric charge to the actuator 22 can be prevented, thus the variation in the drive signal COM can be suppressed and prevented.

Figure 29:
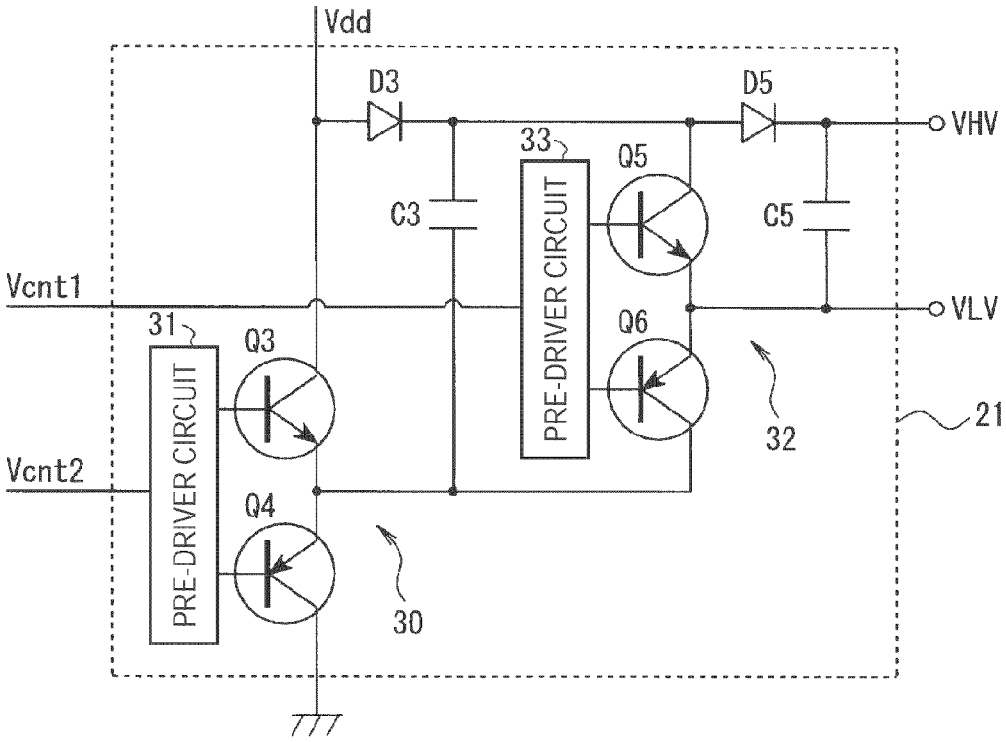
FIG. 29 is a block diagram of the power supply voltage control circuit showing a tenth embodiment of the liquid jet apparatus of the invention.

A tenth embodiment of the liquid jet printing apparatus using the liquid jet apparatus of the invention will hereinafter be explained using FIGS. 29 and 30. All of the schematic configuration, control apparatus, drive signals, and switching controller of the liquid jet apparatus of the tenth embodiment are substantially the same as shown in FIGS. 1 through 5 of the first embodiment described above, and drive circuits thereof are substantially the same as shown in FIGS. 19 through 21 of the sixth embodiment described above. FIG. 29 shows the power supply voltage control circuit 21 of the tenth embodiment. Although the power supply voltage control circuit 21 of the tenth embodiment is substantially the same as what is shown in FIG. 16 of the fifth embodiment described above, the charge source power supply voltage VHV is output from one of the both ends of the capacitor C5 of the anterior stage bootstrap circuit 32, which is connected to the power supply voltage Vdd, and the discharge destination power supply voltage VLV is output from the other of the both ends of the capacitor C5, which is connected to the emitter of the charging transistor Q5.

Figure 30:
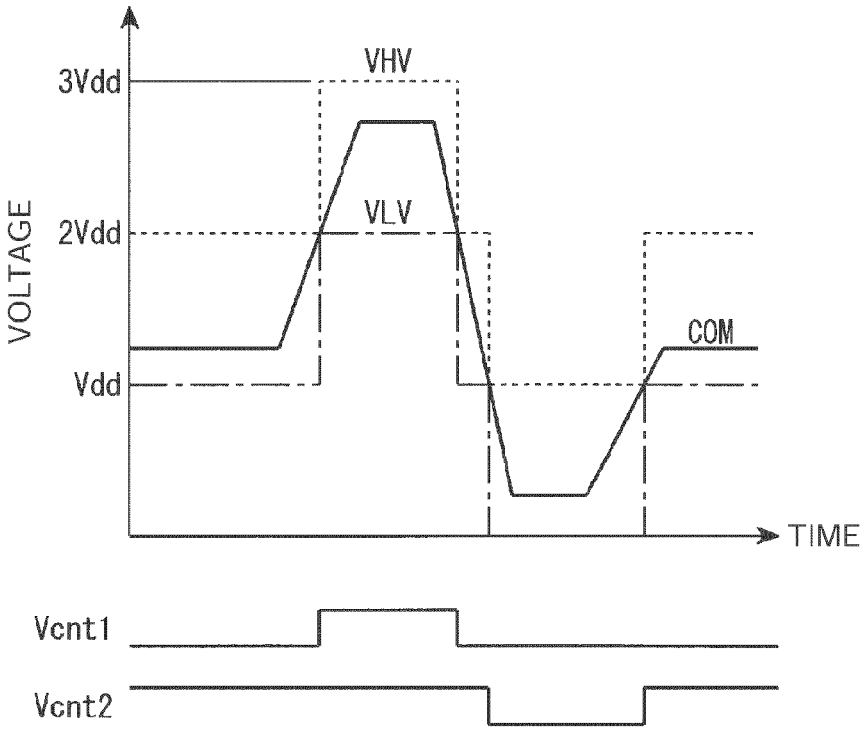
FIG. 30 is a waveform chart of the power supply voltage by the liquid jet apparatus shown in FIG. 29.

FIG. 30 is a voltage waveform chart of the charge source power supply voltage VHV and the discharge destination power supply voltage VLV of the tenth embodiment, The charge source power supply voltage VHV is obtained by switching the base current of the charging transistor Q5, discharging transistor Q6 of the anterior stage bootstrap circuit 32 with the first reference signal Vcnt1, and switching the base current of the charging transistor Q3, discharging transistor Q4 of the posterior stage bootstrap circuit 30 with the second reference signal Vcnt2, and specifically, when the first reference signal Vcnt1 and the second reference signal Vcnt2 are both in the low level, the charging transistor Q5 of the anterior stage bootstrap circuit 32 and the charging transistor Q3 of the posterior stage bootstrap circuit 30 are both switched off to set the charge source power supply voltage VHV to be the power supply voltage Vdd and the discharge destination power supply voltage VLV to be OV, when only the second reference signal Vcnt2 is in the high level, only the charging transistor Q3 of the posterior stage bootstrap circuit 30 is switched on to set the charge source power supply voltage VHV to be doubled of the power supply voltage Vdd and the discharge destination power supply voltage VLV to be the power supply voltage Vdd, and when the first reference signal Vcnt1 and the second reference signal Vcnt2 are both in the high level, the charging transistor Q5 of the anterior stage bootstrap circuit 32 and the charging transistor Q3 of the posterior bootstrap circuit 30 are both switched on to set the charge source power supply voltage VHV to be tripled of the power supply voltage Vdd and the discharge destination power supply voltage VLV to be doubled of the power supply voltage Vdd.

Also in the tenth embodiment, since it becomes possible to reduce the difference in voltage between the drive signal COM and the charge source power supply voltage VHV, it becomes possible to reduce the loss and the heat generation.

As described above, according to the tenth embodiment, since it is arranged that the power supply voltage control circuit 21 is configured with the power supply circuit capable of stepping up the charge source power supply voltage VHV, discharge destination power supply voltage VLV with the anterior stage bootstrap circuit 32, the posterior stage bootstrap circuit 30, and the stepping up of the charge source power supply voltage VHV, discharge destination power supply voltage VLV by the bootstrap circuits 30, 32 is controlled by the reference signals Vcnt1, Vcnt2, it is suitable for realizing the power supply voltage control circuit 21, and it becomes possible to obtain higher charge source power supply voltage VHV, discharge destination power supply voltage VLV to the drive signal COM using the lower power supply voltage Vdd, in addition to the advantage of the sixth embodiment.

Further, as described above, according to the tenth embodiment, higher charge source power supply voltage VHV, discharge destination power supply voltage VLV to the drive signal COM can be obtained using a much lower power supply voltage Vdd in addition to the advantage of the eighth embodiment.

Figure 31:
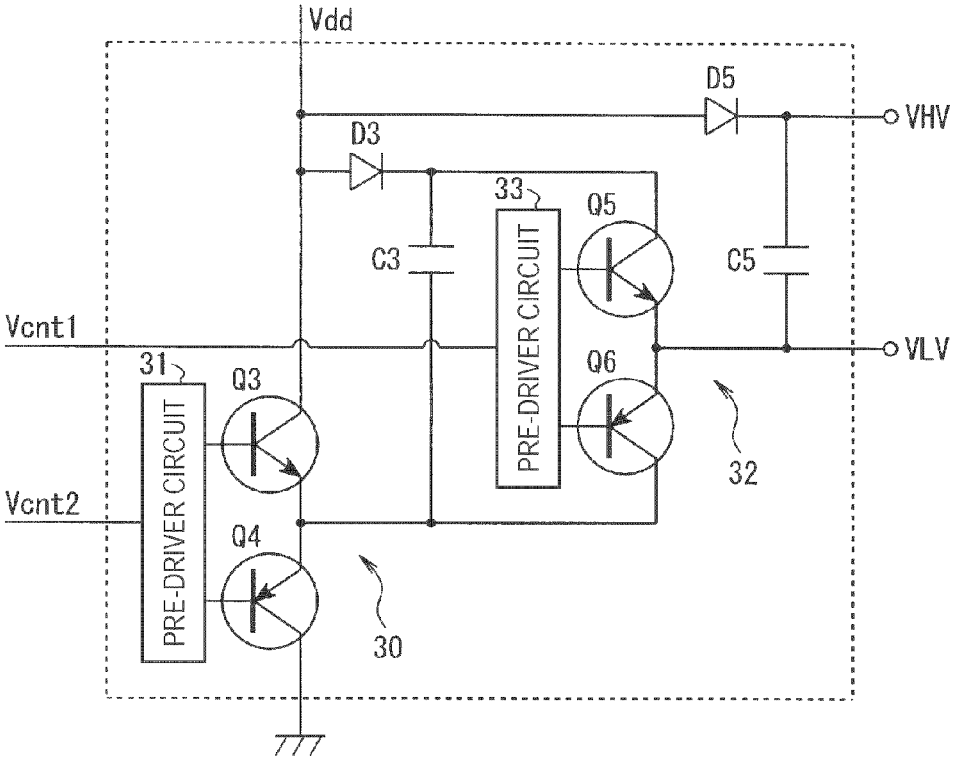
FIG. 31 is a block diagram of another example of the power supply voltage control circuit shown in FIG. 29.

It should be noted that it is also possible to dispose the diodes D31, D32 for preventing back-flow on the output side of the anterior stage bootstrap circuit 32 of the power supply voltage control circuit 21 of the tenth embodiment similarly to the case of the fourth embodiment. Further, it is also possible to connect the back-flow preventing diodes D3, D5 to the power supply voltage Vdd in parallel to each other as shown in FIG. 31. If the back-flow preventing diodes D3, D5 are connected in series as shown in FIG. 29, the input voltage to the anterior stage bootstrap circuit 32 drops as much as the voltage drop in the back-flow preventing diode D3 on the input side. Although the voltage drop by the diode is extremely small, the input voltage to the anterior stage bootstrap circuit 32 still drops as much as the voltage drop, and therefore, in order for avoiding the voltage drop, it is possible to connect the back-flow preventing diodes D3, D5 to the power supply voltage Vdd in parallel to each other as shown in FIG. 31.

It should be noted that although in the first through tenth embodiment only the case in which only the charge source power supply voltage VHV to the actuator 22 as a charge-discharge actuator is controlled or both of the charge source power supply voltage VHV and the discharge destination power supply voltage VLV are controlled is explained, by controlling only the discharge destination power supply voltage VLV using the similar configuration, the difference in voltage between the drive signal COM and the discharge destination power supply voltage VLV s reduced, and thus reduction of the loss and the heat generation becomes possible.

Further, although in the first through tenth embodiment only the examples applying the liquid jet apparatus of the invention to the line head printing apparatus as the object are described in detail, the liquid jet apparatus of the invention can be applied to all types of printing apparatuses as the object including a multi-pass printing apparatus, Further, each section constituting the liquid jet apparatus of the present invention can be replaced with an arbitrary constituent capable of exerting a similar function, or added with an arbitrary constituent.

Further, the liquid jet apparatus of the invention can also be embodied as a liquid jet apparatus for emitting a jet of a liquid (including a liquid like member dispersing particles of functional materials, and a fluid such as a gel besides liquids) other than the ink, or a fluid (e.g., a solid substance capable of flowing as a fluid and being emitted as a jet) other than liquids. The liquid jet apparatus can be, for example, a liquid jet apparatus for emitting a jet of a liquid including a material such as an electrode material or a color material used for manufacturing a liquid crystal display, an electro-luminescence (EL) display, a plane emission display, or a color filter in a form of a dispersion or a solution, a liquid jet apparatus for emitting a jet of a living organic material used for manufacturing a biochip, or a liquid jet apparatus used as a precision pipette for emitting a jet of a liquid to be a sample.

Further, the liquid jet apparatus can be a liquid jet apparatus for emitting a jet of lubricating oil to a precision machine such as a timepiece or a camera in a pinpoint manner, a liquid jet apparatus for emitting on a substrate a jet of a liquid of transparent resin such as ultraviolet curing resin for forming a fine hemispherical lens (optical lens) or the like used for an optical communication device or the like, a liquid jet apparatus for emitting a jet of an etching liquid of an acid or an alkali for etching a substrate or the like, a fluid jet apparatus for emitting a gel jet, or a fluid jet recording apparatus for emitting a jet of a solid substance including fine particles such as a toner as an example. Further, the invention can be applied to either one of these jet apparatuses.

The entire disclosure of Japanese Patent Application No. 2008-071942 filed on Mar. 19, 2008 is expressly incorporated by reference herein

What is claimed is:

1. A liquid jet apparatus comprising:

a drive circuit adapted to apply a drive signal to an actuator of a liquid jet head, the drive circuit also being configured to generate a reference signal based on the drive signal such that the reference signal has a high level when the drive signal is higher than a predetermined voltage and such that the reference signal has a low level when the drive signal is lower than the predetermined voltage; and a power supply voltage control circuit adapted to control a power supply voltage to the drive signal of the drive circuit to be a voltage based on the reference signal obtained from the drive circuit, wherein the power supply voltage control circuit includes:

a bootstrap circuit adapted to control stepping up of the power supply voltage based on a reference signal; and a diode adapted to prevent back-flow is disposed on an output side of the bootstrap circuit.

2. A printing apparatus comprising:

a liquid jet apparatus having a drive circuit adapted to apply a drive signal to an actuator of a liquid jet head the drive circuit also being configured to generate a reference signal based on the drive signal such that the reference signal has a high level when the drive signal is higher than a predetermined voltage and such that the reference signal has a low level when the drive signal is lower than the predetermined voltage, and a power supply voltage control circuit adapted to control a power supply voltage to the drive signal of the drive circuit to be a voltage based on the reference signal obtained by the drive circuit, wherein the power supply voltage control circuit includes:

a bootstrap circuit adapted to control stepping up of the power supply voltage based on a reference signal; and a diode adapted to prevent back-flow is disposed on an output side of the bootstrap circuit.

* * * * *